US011745242B2

(12) United States Patent
Smith et al.

(10) Patent No.: US 11,745,242 B2
(45) Date of Patent: Sep. 5, 2023

(54) MACHINES TO ROLL-FORM VARIABLE COMPONENT GEOMETRIES

(71) Applicant: The Bradbury Company, Inc., Moundridge, KS (US)

(72) Inventors: Gregory S. Smith, McPherson, KS (US); Jamie Wollenberg, Moundridge, KS (US); Dustin Krug, Moundridge, KS (US)

(73) Assignee: THE BRADBURY CO., INC., Moundridge, KS (US)

( * ) Notice: Subject to any disclaimer, the term of this patent is extended or adjusted under 35 U.S.C. 154(b) by 54 days.

(21) Appl. No.: 16/571,539

(22) Filed: Sep. 16, 2019

(65) Prior Publication Data

US 2020/0094303 A1 Mar. 26, 2020

Related U.S. Application Data

(60) Provisional application No. 62/734,450, filed on Sep. 21, 2018.

(51) Int. Cl.

| | |
|---|---|
| ***B21D 5/08*** | (2006.01) |
| ***B21D 5/14*** | (2006.01) |
| ***B21D 19/04*** | (2006.01) |

(52) U.S. Cl.

CPC ..... *B21D 5/083* (2013.01); *B21D 5/14* (2013.01)

(58) Field of Classification Search

CPC .. B21D 5/06–083; B21D 5/14; B21D 19/043; B21D 19/04; B21D 37/04; B23Q 15/013; B23Q 15/02

(Continued)

(56) References Cited

U.S. PATENT DOCUMENTS 606,306 A * 6/1898 Shann et al. ..... B21D 5/08 72/178
3,462,989 A * 8/1969 Fischer, Jr. ..... B21D 5/08 72/178

(Continued)

FOREIGN PATENT DOCUMENTS

AU 2005200334 8/2010
AU 2010214719 3/2016

(Continued)

OTHER PUBLICATIONS

Comau, Robot Roller Hemming: Comau RHEvo, Apr. 18, 2014, Youtube, https://www.youtube.com/watch?v=o3v_I82o3FU (Year: 2014).*

(Continued)

*Primary Examiner* — Matthew Katcoff
*Assistant Examiner* — Mohammed S. Alawadi
(74) *Attorney, Agent, or Firm* — Hanley, Flight & Zimmerman, LLC

(57) ABSTRACT

Apparatus, systems, methods, and articles of manufacture are disclosed herein that flexibly form variable component geometries in a roll-forming process. An example roll-forming apparatus includes a forming unit to move along a stationary component to form a cross-section in the component, a first roll operatively coupled to the forming unit to engage the component, and a second roll operatively coupled to the forming unit to set a forming angle for movement along the component, the component formed between the first roll and the second roll.

23 Claims, 15 Drawing Sheets

(58) Field of Classification Search
USPC ..... 72/178, 179, 181, 446–448
See application file for complete search history.

(56) References Cited

U.S. PATENT DOCUMENTS

| | | | | | |
|---|---|---|---|---|---|
| 3,783,665 | A | | 1/1974 | Ashizawa | |
| 3,914,971 | A | * | 10/1975 | Colbath | B21D 5/083 72/178 |
| 4,057,990 | A | * | 11/1977 | Kelsey | B21D 5/14 74/609 |
| 4,096,728 | A | * | 6/1978 | Decker | B21D 45/04 72/345 |
| 4,117,702 | A | | 10/1978 | Foster | |
| 4,558,577 | A | | 12/1985 | Trishevsky et al. | |
| 4,559,577 | A | | 12/1985 | Shoji et al. | |
| 4,787,232 | A | | 11/1988 | Hayes | |
| 4,878,368 | A | | 11/1989 | Toutant et al. | |
| 4,969,346 | A | * | 11/1990 | Bosl | E04C 2/322 72/181 |
| 5,010,756 | A | | 4/1991 | Nose et al. | |
| 5,142,894 | A | * | 9/1992 | Gutowski | B21D 5/083 72/181 |
| 5,722,278 | A | | 3/1998 | Horino et al. | |
| 5,970,769 | A | | 10/1999 | Lipari | |
| 6,109,083 | A | | 8/2000 | Steinmair | |
| 6,167,740 | B1 | | 1/2001 | Lipari et al. | |
| 6,477,879 | B1 | | 11/2002 | Sawa | |
| RE38,064 | E | | 4/2003 | Morello | |
| 6,644,086 | B1 | * | 11/2003 | Bodnar | B21D 5/08 72/181 |
| 7,107,807 | B2 | | 9/2006 | Ingvarsson et al. | |
| 7,111,481 | B2 | | 9/2006 | Green et al. | |
| 7,325,427 | B2 | | 2/2008 | Ingvarsson | |
| 7,441,432 | B2 | | 10/2008 | Ingvarsson | |
| 7,591,161 | B2 | | 9/2009 | Green et al. | |
| 8,181,499 | B2 | | 5/2012 | Ingvarsson | |
| 8,234,899 | B1 | * | 8/2012 | Chuang | B21D 5/08 72/179 |
| 8,453,485 | B2 | | 6/2013 | Smith et al. | |
| 8,601,845 | B2 | | 12/2013 | Ingvarsson | |
| 8,650,923 | B2 | | 2/2014 | Ingvarsson | |
| 8,794,044 | B2 | | 8/2014 | Ingvarsson | |
| 9,056,345 | B2 | | 6/2015 | Freitag et al. | |
| 9,370,813 | B2 | | 6/2016 | Smith et al. | |
| 9,475,108 | B2 | | 10/2016 | Ingvarsson | |
| 9,776,227 | B2 | | 10/2017 | Li et al. | |
| 2005/0178181 | A1 | | 8/2005 | Green et al. | |
| 2006/0272376 | A1 | | 12/2006 | Green et al. | |
| 2008/0121007 | A1 | | 5/2008 | Ingvarsson | |
| 2009/0113974 | A1 | * | 5/2009 | Ingvarsson | B21D 5/083 72/181 |
| 2010/0083722 | A1 | | 4/2010 | Bachthaler et al. | |
| 2010/0139350 | A1 | * | 6/2010 | Smith | B21D 5/08 72/11.2 |
| 2011/0107808 | A1 | * | 5/2011 | Gil | B21D 5/14 72/224 |
| 2011/0179842 | A1 | | 7/2011 | Freitag et al. | |
| 2012/0028068 | A1 | | 2/2012 | Sedlmaier et al. | |
| 2013/0263636 | A1 | | 10/2013 | Smith et al. | |
| 2013/0276497 | A1 | | 10/2013 | Ingvarsson | |
| 2015/0027641 | A1 | | 1/2015 | Lee et al. | |
| 2016/0023256 | A1 | | 1/2016 | Li et al. | |
| 2018/0050377 | A1 | * | 2/2018 | Lee | B21D 19/043 |

FOREIGN PATENT DOCUMENTS

| | | | | | |
|---|---|---|---|---|---|
| CA | 2240249 | | | 12/1999 | |
| CA | 2497481 | | | 8/2005 | |
| CA | 2240249 | C | * | 9/2009 | B21D 5/08 |
| CA | 2714126 | | | 10/2017 | |
| CN | 207343534 | | | 5/2018 | |
| DE | 202004012580 | | | 9/2005 | |
| DE | 202004012580 | U1 | * | 9/2005 | B21D 19/04 |
| DE | 102007005614 | | | 8/2008 | |
| DE | 102007024777 | | | 11/2008 | |
| DE | 102017101235 | | | 7/2018 | |
| DE | 102017101235 | A1 | * | 7/2018 | B21D 5/08 |
| EP | 1245302 | | | 10/2002 | |
| EP | 1563922 | | | 2/2005 | |
| EP | 1889672 | | | 2/2008 | |
| EP | 2289642 | | | 3/2011 | |
| EP | 3753644 | A1 | * | 12/2020 | B21D 5/083 |
| ES | 2426469 | | | 10/2013 | |
| FR | 2766740 | | | 2/1999 | |
| JP | S60238037 | | | 11/1985 | |
| JP | 60255215 | A | * | 12/1985 | B21D 5/08 |
| KR | 20180064229 | | | 6/2018 | |
| WO | 9704892 | | | 2/1997 | |
| WO | 2010101295 | | | 9/2010 | |

OTHER PUBLICATIONS

English translate (DE202004012580U1), retrieved date Dec. 18, 2021 (Year: 2021).*

Canadian Patent Office, "Office action," issued in connection with Canadian patent application No. 3054697, dated Dec. 15, 2020, 10 pages.

International Searching Authority, "Extended European Search Report," issued in connection with International Patent Application No. 19197464.1, dated Nov. 29, 2019, 8 pages.

IP Australia, "Examination Report No. 1," mailed in connection with Application No. 2019226291, dated Jun. 23, 2019, 5 pages.

Canadian Patent Office, "Office action," dated Jun. 21, 2021 in connection with Canadian Patent Application No. 3,054,697, 8 pages.

Canadian Intellectual Property Office, "Office Action," dated Jan. 26, 2022 in connection with Canadian Patent Application No. 3,054,697, 15 pages.

Canadian Intellectual Property Office, "Office Action," dated Sep. 22, 2022 in connection with Canadian Patent Application No. 3,054,697, 10 pages.

European Patent Office, "Communication Pursuant to Article 94(3) EPC," dated Oct. 23, 2020 in connection with European Patent Application No. 19197464.1, 8 pages.

Canadian Intellectual Property Office, "Notice of Allowance," dated Apr. 11, 2023 in connection with Canadian Patent Application No. 3,054,697, 1 page.

* cited by examiner

MACHINES TO ROLL-FORM VARIABLE COMPONENT GEOMETRIES

RELATED APPLICATION

This patent claims the benefit of and priority to U.S. Provisional Patent Application Ser. No. 62/734,450, which was filed on Sep. 21, 2018. U.S. Provisional Patent Application Ser. No. 62/734,450 is hereby incorporated herein by reference in its entirety.

FIELD OF THE DISCLOSURE

This disclosure relates generally to roll-forming machines, and, more particularly, to machines to roll-form variable component geometries.

BACKGROUND

Roll-forming processes are typically used to manufacture components such as construction panels, structural beams, garage doors, and/or other components having a formed profile. A standard roll-forming process may be implemented by using a roll-forming machine or system having a plurality of sequenced work rolls. The work rolls are typically configured to progressively contour, shape, bend, cut, and/or fold a moving material. The moving material may be, for example, strip material (e.g., a metal) that is pulled from a roll or coil of the strip material and processed using a roll-forming machine or system. As the material moves through the roll-forming machine or system, the work rolls perform a bending and/or folding operation on the material to progressively shape the material to achieve a desired profile.

A roll-forming process may be a post-cut process or a pre-cut process. An example known post-cut process involves unwinding a strip material from a coil and feeding the continuous strip material through the roll-forming machine or system. In some cases, the strip material is leveled, flattened, and/or otherwise conditioned prior to entering the roll-forming machine or system. A plurality of bending, folding, and/or forming operations are then performed on the strip material as the strip material moves through the work rolls to produce a formed material having a desired profile. The continuous formed strip material is then passed through the last work rolls and moved through a cutting or shearing press that cuts the formed material into sections having a predetermined length. In an example known pre-cut process, the strip is passed through a cutting or shearing press prior to entering the roll-forming machine or system. In this manner, pieces of formed material having a pre-determined length are individually processed by the roll-forming machine or system.

BRIEF DESCRIPTION OF THE DRAWINGS

The figures are not to scale. Instead, the thickness of the layers or regions may be enlarged in the drawings. In general, the same reference numbers will be used throughout the drawing(s) and accompanying written description to refer to the same or like parts.

DETAILED DESCRIPTION

Figure 1B:
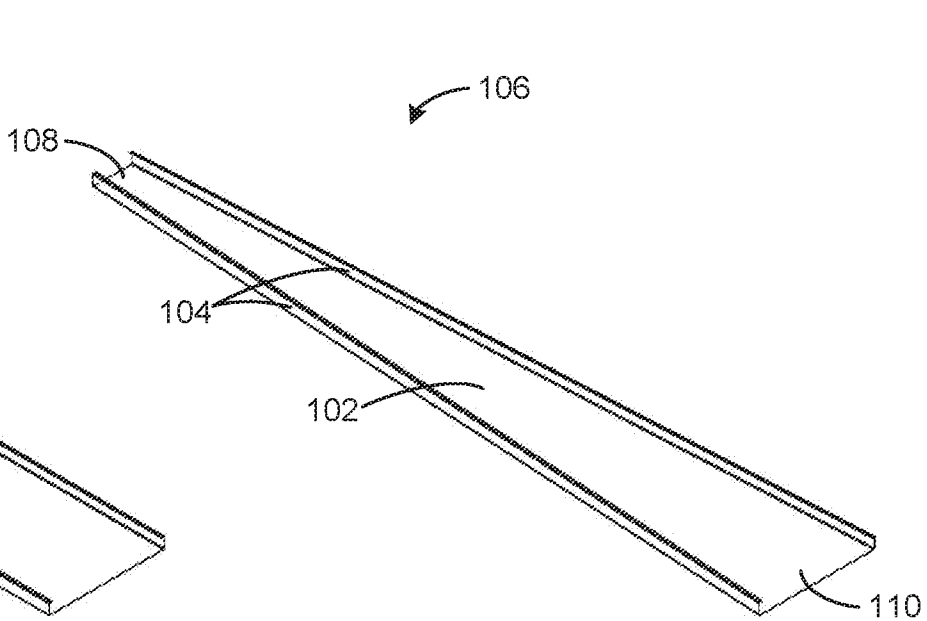
FIG. 1B is a schematic illustration of an example variable cross-section component.

In roll-forming processes, roll-forming machines or systems having a sequenced plurality of work rolls are utilized to gradually, iteratively, and/or progressively form a component (e.g., sheet metal, strip material, etc.) into a desired shape (e.g., cross-section or geometry). The number of work rolls used to form a component may be dictated by the characteristics of the material (e.g., material strength, thickness, etc.) and the profile complexity of the formed component (e.g., the number of bends, folds, etc. needed to produce a finished component). A plurality of bending, folding, and/or forming operations are performed on the component as the component moves through the work rolls to produce a formed material having a desired profile. In such examples, a pass refers to the movement of the component through a work roll or pair of work rolls. However, forming components with highly irregular cross-sectional profiles becomes difficult using some roll-forming machines or systems, as the high number of features may lead to a high number passes through the roll-forming machine or system. For example, a profile requiring several features can utilize several passes for each feature, increasing time, space, and cost required to form the complex profiles.

Some problems arising with known roll-forming machines or systems are exacerbated by demands for high-volume output of these complex profiles. To achieve high-volume output, the irregular cross-sections are to be formed quickly and efficiently. Further, thickness of the material used to form the component (e.g., sheet metal) can add to the number of work rolls needed to shape the profile of the component (e.g., a higher number of work rolls may be used to form a thicker material than the number of work rolls used to form a thinner material). These increased demands reduce the effectiveness of the known roll-forming machines or systems that utilize a plurality of work rolls.

Further, defects may occur throughout the forming of the component when using the known roll-forming machines and systems. For example, when forming the component, several types of defects can occur, including, for example, flare, bow, twist, and/or buckling. Flare refers to inward or outward deformation of an end of a component during a roll-forming process. In some examples, one end of the component may flare outward and the other end of the component may flare inward. In some examples, flare is caused by a slapping effect when the component enters a first set of work rolls in the roll-forming process. The slapping effect causes flaring of the first end of the component due to a misalignment between a first set or pair of work rolls and the component (e.g., the component deflects off of the work rolls). Bow refers to a deviation from a straight line in a vertical direction of the component profile (e.g., a horizontal surface of the component bows up or down relative to a horizontal plane). Twist refers to a rotation of two opposing ends of the component in opposite directions (e.g., the component resembles a corkscrew). Buckling refers to an outward deflection of a component profile. In known roll-forming machines and systems, defects that occur in the component are addressed after the component is finished, adding to the production time of the components, as well as increasing the stress and strain on the component.

In some examples, brake forming (e.g., using a press brake) is used to form complex component profiles in a material. Press brakes are machine pressing tools used for bending sheet and plate material (e.g., sheet metal) into predetermined shapes (e.g., component profiles). For example, a piece of sheet metal can be clamped in place between a machine punch and a die. The machine punch applies a force (e.g., by mechanical means, pneumatic means, hydraulic means, etc.) to the material, which is pressed into a die having a specific shape. When the machine punch presses the material into the die, the material is contoured, shaped, bent, cut, and/or folded into a desired shape or profile. However, press brakes become less cost-effective when there is a demand for high-volume output and are not able to form components fast enough to meet the high output demands.

The example roll-forming machines or systems disclosed herein are capable of forming high volumes of components into highly complex profiles in a quick and efficient manner. The examples disclosed herein include roll-forming assemblies having movable forming units with a plurality of work rolls operatively coupled to the forming units. The forming units can move relative to the component to form constant or variable cross-sections in the components. In some examples, the forming units make multiple passes along the component to form the cross-section. In some such examples, the angle of the forming unit relative to the component and/or the angle of one or more of the plurality of work rolls relative to the component are adjusted after one or more of the passes of the forming unit. Thus, multiple passes of the forming unit can be accomplished quickly to form the component cross-section. Further, the ability to adjust the position and/or angle of the forming unit, as well as each of the plurality of work rolls operatively coupled to the forming units, allows additional flexibility to switch between different cross-sections.

Further, the examples disclosed herein can correct for defects, such as flare, bow, twist, and/or buckling, during the initial forming of the component. For example, the examples disclosed herein can detect a defect during a pass of a forming unit over the component. During a subsequent pass, the forming unit can adjust a forming angle to correct for the defect. As used herein, the forming angle refers to an angle of a contour, bend, and/or fold that is formed in a component by a forming unit. In this way, the defect is eliminated while the component is still being formed, saving time and reducing the overall stress on the component. Additionally, the examples disclosed herein can optimize the roll-forming process for each component profile using closed-loop logic feedback.

Figure 1A:
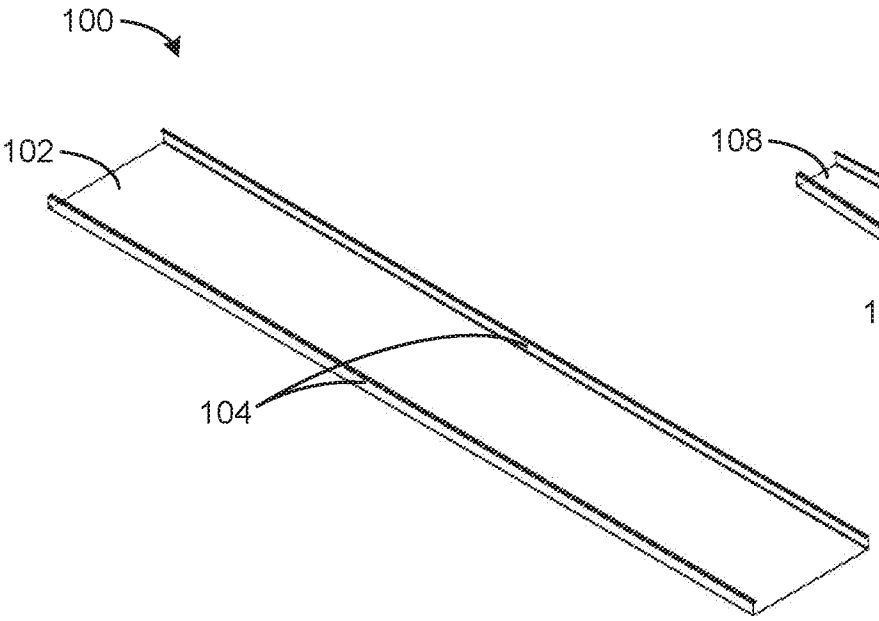
FIG. 1A is a schematic illustration of an example constant cross-section component.

FIG. 1A is a schematic illustration of an example constant cross-section component 100. The example constant cross-section component 100 includes a web 102 and legs 104. In some examples, the constant cross-section component 100 is a single piece of sheet metal that is bent, contoured, and/or folded into the profile shown in FIG. 1A. The web 102 of the illustrated example is a horizontal section of the constant cross-section component 100. The web 102 has a constant width and forms a base of the constant cross-section component 100. The legs 104 of the illustrated example are bent relative to the web 102 (e.g., at an angle of 90°). The legs 104 are equal in height across a length of the constant cross-section component 100. The legs 104 extend upward from the web 102 on each side to form a profile of the constant cross-section component 100. In some examples, top portions of the legs 104 are bent (e.g., inward and parallel to the web 102). Such a bend in the profile of the constant cross-section component 100 is referred to herein as a lip. A further bend in the lip (e.g., a bend downward parallel to the legs 104) can, in some examples, be referred to as a c-plus. For example, the profile of the constant cross-section component 100 can include the web 102, the legs 104, lips extending from the legs 104 (e.g., a lip on each of the legs 104), and a c-plus formed by bending a portion of the lips downward on each side of the constant cross-section component 100.

FIG. 1B is a schematic illustration of an example variable cross-section component 106. The variable cross-section component 106 has a first end 108 and a second end 110. The variable cross-section component 106 further includes a web 102 and legs 104. In the illustrated example, a width of the web 102 at the first end 108 is less than the width of the web 102 at the second end 110. The cross-section of the variable cross-section component 106 thus varies along a length of the variable cross-section component 106. In some examples, the variable cross-section component 106 can have a shape different than that shown in FIG. 1B. The cross-section can have any transitioning, variable, irregular, and/or otherwise changing cross-section along a length, width, arc, and/or other section, subsection, and/or part or whole of the component. In some examples, the variable cross-section component 106 includes lips and/or c-plusses as discussed in connection with FIG. 1A. In some examples, a material (e.g., sheet metal) is cut prior to being formed into the variable cross-section component 106. In examples used herein, a pre-cut component is referred to as a blank.

Figure 1C:
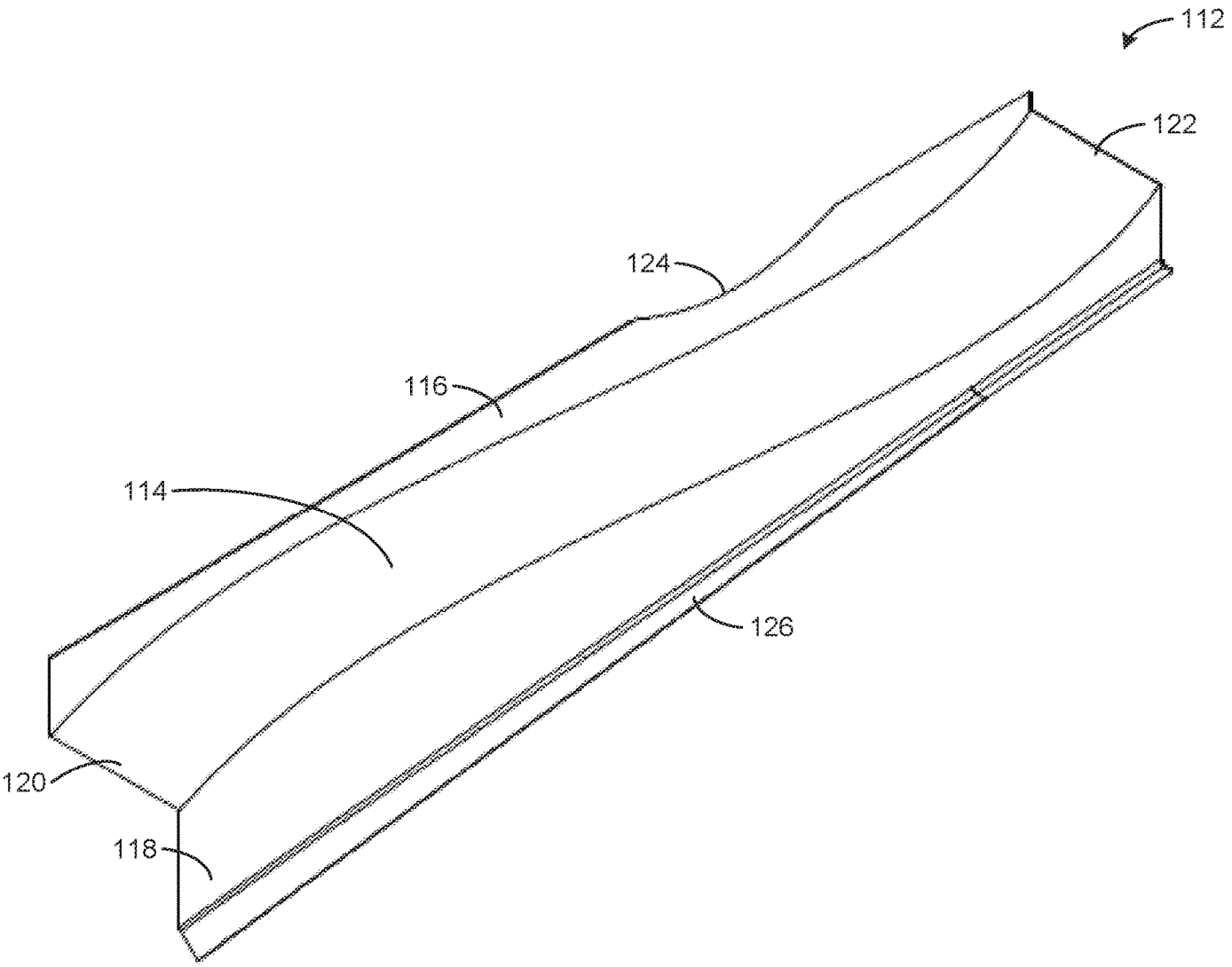
FIG. 1C is a schematic illustration of an example asymmetric and variable cross-section component.

FIG. 1C is a schematic illustration of an example asymmetric cross-section component 112, which also has a variable cross-section. In the illustrated example, the asymmetric cross-section component 112 includes a curved web 114. The example curved web 114 has a changing height along a length of the asymmetric cross-section component 112. For example, the curved web 114 of the asymmetric cross-section component 112 has a generally sinusoidal shape along the length of the asymmetric cross-section component 112. The asymmetric cross-section component 112 further includes an example first leg 116 and an example second leg 118. In some examples, the asymmetric cross-section component 112 is cut out of a blank prior to being formed. In the illustrated example, the first leg 116 is formed upward relative to the curved web 114, while the second leg 118 is formed downward relative to the curved web 114. The height (e.g., as measured from an edge of the curved web 114) of the first leg 116 and the second leg 118 varies along the length of the asymmetric cross-section component 112 due to the curvature of the curved web 114. For example, the height of the first leg 116 is larger at a first end 120 of the asymmetric cross-section component 112 than at a second end 122 because the curved web 114 is curving downward at the first end 120 and is curving upward at the second end 122.

Additionally, the first leg 116 includes a curved cutout 124 that is cut into the first leg 116. For example, the first leg 116 can be formed upward relative to the curved web 114 in a first pass, and the curved cutout 124 can be cut out of the first leg 116 in a second pass. The asymmetric cross-section component 112 further includes an example lip 126 formed into the second leg 118. The example lip 126 varies in width (e.g., as measured from the second leg 118) between the first end 120 and the second end 122. For example, the lip 122 has a larger width at the first end 120 and a smaller width at the second end 122. Further, in the illustrated example, an angle between the lip 126 and the second leg 118 decreases from the first end 120 to the second end 122. Additionally or alternatively, the angle between the lip 126 and the second leg 118 can increase from the first end 120 to the second end 122. Systems, apparatus, and methods disclosed herein are capable of forming the constant cross-section component 100, the variable cross-section component 106, and/or the asymmetric cross-section component 112.

Figure 2:
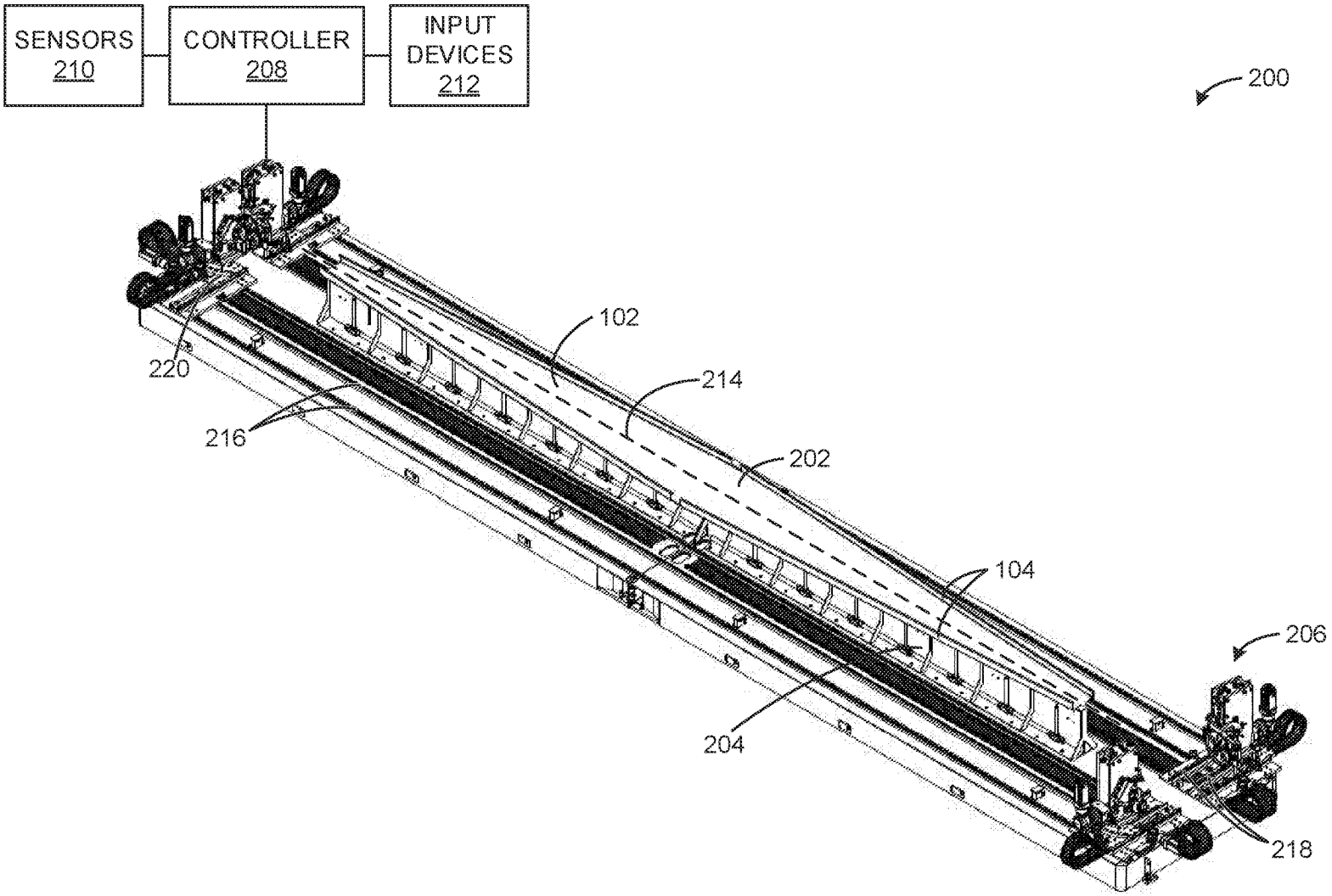
FIG. 2 is a schematic illustration of an example roll-forming assembly.

FIG. 2 is a schematic illustration of an example roll-forming assembly 200. The roll-forming assembly 200 forms a profile in an example component 202. In the illustrated example, the component 202 has a variable cross-section. In alternative examples, the roll-forming assembly 200 can form a profile in any other variable cross-section components (e.g., the variable cross-section component 106 of FIG. 1B) or in constant cross-section components (e.g., the constant cross-section component 100 of FIG. 1A) or asymmetric cross-section components (e.g., the asymmetric cross-section component 112 of FIG. 1C). The component 202 is coupled to an example stand 204 to hold the component 202 stationary. In some examples, the stand 204 maintains the position of the component 202 using magnetic forces, clamps, mechanical stop pins, pneumatic suction cups, and/or other holding means. In some alternative examples, the component 202 moves relative to the roll-forming assembly 200. For example, the component 202 can be moved by a transporter or transporters, such as, for example, feed rolls, a traveling gripper system, robot arms, and/or other actuators.

The roll-forming assembly 200 of the illustrated example further includes example forming units 206. In the illustrated example, the forming units 206 move along the component 202, which is held stationary by the stand 204, to form the component 202 into the desired profile. In the illustrated example, four forming units 206 are used to form the component 202 into the profile shown in FIG. 2. Additionally or alternatively, the roll-forming assembly 200 can form a component into any desired profile. Also, though four forming units 206 are shown in FIG. 2, in other examples, any other number of forming units 206 may be included such as, for example, one, two, three, five, etc. The forming units 206 include an example controller 208 to determine positions of the forming units 206 during the roll-forming process. For example, the controller 208 controls a position and/or an angle of the forming unit 206 relative to the component 202. Further, the controller 208 controls positions and/or angles of work rolls and/or other devices coupled to the forming unit 206, as disclosed further in connection with FIG. 3.

The controller 208 is in communication with one or more example sensors 210. In some examples, the sensors 210 include a profilometer to measure a profile of the component 202. In some examples, the sensors 210 measure angles, lengths, distances, and/or other parameters of the component 202 (e.g., of the example web 102, legs 104, lips, and c-plusses of FIGS. 1A and/or 1B). In some examples, an outer edge of the component 202 is detected by the sensors 210 (e.g., a profilometer, an ultrasonic sensor, a capacitive sensor, an inductive sensor, etc.), and the forming unit 206 then forms the profile of the component 202 using the outer edge as a reference point. For example, when the sensors 210 detect the outer edge of the component 202, the forming unit 206 can form a feature (e.g., the legs 104 of FIGS. 1A and 1B) at a specified distance from the outer edge to maintain consistency of the feature along the length of the component 202. In such examples, a feature formed by the forming unit 206 will have a consistent dimension along the component 202, regardless of whether the blank was cut correctly (e.g., regardless of an imperfection resulting from the cutting process prior to forming). The controller 208 is further communicatively coupled to example input devices 212. In some examples, the input devices 212 receive input from an operator to determine a profile and/or other parameters of the component 202. In some examples, the input devices 212 include one or more of a touch screen, a keyboard, a mouse, a computer, a microphone, etc.

In the illustrated example, the component 202 has a central axis 214 centrally located along a length of the component 202. The example forming units 206 move along an example parallel track 216 (e.g., approximately parallel to the central axis 214) to move along the component 202. For example, each forming unit 206 can move between an end of the roll-forming assembly 200 and a middle section of the component 202. In such examples, the forming units 206 apply a force to the component 202 when the forming units pass between the end of the roll-forming assembly 200 and the middle of the component 202. As used herein, a pass refers to movement of the forming unit 206 along a length or section of the component 202 during a roll-forming process. The forming units 206 can make multiple passes along the component 202 to gradually, iteratively, and/or otherwise progressively form the desired profile. For example, the angle of the forming units 206 relative to the component 202 can change between one or more of the passes over the component 202 until the legs 104 are formed approximately perpendicular to the web 102 of the component 202.

The example roll-forming assembly 200 further includes a perpendicular track 218 (e.g., approximately perpendicular to the central axis 214) on which the forming unit 206 moves toward and/or away from the central axis 214 of the component 202. For example, as the forming unit 206 moves along the parallel track 216, the cross-section of the component 202 becomes wider (e.g., toward the middle of the component 202). Accordingly, the forming unit 206 can move away from the central axis 214 (e.g., when the forming unit 206 moves toward a middle of the component 202 along the parallel track 216) and toward the central axis 214 when the forming unit 206 moves away from the middle of the component 202 (e.g., back toward the end of the component 202 where the web 102 is relatively narrower). This lateral change in position of the forming units 206 (e.g., movement toward or away from the central axis 214) enables the legs 104 of the component 202 to be equal in height along the entirety of the component 202 (e.g., as the component 202 becomes wider, the forming units 206 move laterally outward to fold the legs 104 at a same distance from an edge of the component 202).

In the illustrated example, the forming unit 206 is mounted on an adjustment stand 220. In some examples, the adjustment stand 220 adjusts the angle of the forming unit 206 relative to the component 202. For example, the adjustment stand 220 can adjust the angle of the forming unit 206 to change a forming angle of the forming unit 206 when forming the legs 104 of the component 202. Further, the adjustment stand 220 can adjust the angle of the forming unit 206 to facilitate an interface between the forming unit 206 and the component 202. The facilitated or improved interface allows the forming unit 206 to engage the component 202 tightly to reduce defects (e.g., flare) during a pass of the forming unit 206 along the component 202. In some examples, the adjustment stand 220 further increases or decreases a vertical position of the forming unit 206 (e.g., relative to the web 102 of the component 202). For example, if a new feature were to be formed at the top of the legs 104 (e.g., a lip), the adjustment stand 220 could move the forming unit 206 vertically upward to put the forming unit 206 in the proper position to form such a feature.

In some alternative examples, the roll-forming assembly 200 includes two forming units 206. In such examples, the parallel track 216 extends along the entirety of the roll-forming assembly 200, and the forming units 206 move along the length of the component 202. In some examples, when the roll-forming assembly 200 includes two forming units 206, the forming units 206 include the same capability to adjust the angle and/or position of the forming units 206, the work rolls, and/or other devices operatively coupled to the forming units 206. In some examples, the roll-forming assembly 200 includes multiple forming units 206 moving on the parallel track 216 along a same section of the component 202. For example, the forming units 206 can move consecutively over the same section of the component 202.

Figure 3:
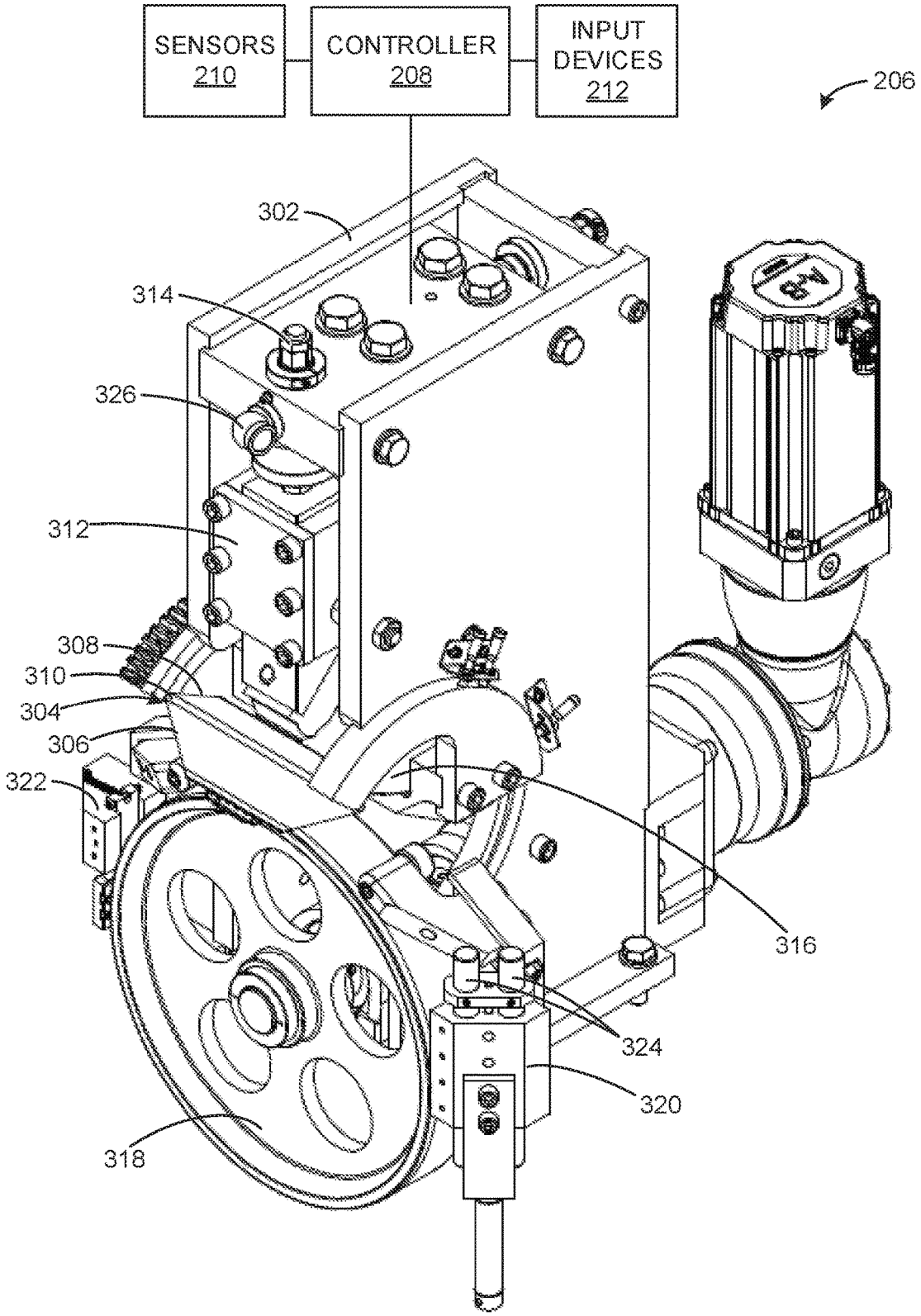
FIG. 3 is a schematic illustration of the example forming unit of FIG. 2.

FIG. 3 is a schematic illustration of the example forming unit 206 of FIG. 2. The forming unit 206 of the illustrated example includes an example housing 302 to house elements (e.g., work rolls) of the forming unit 206 used in the roll-forming process. In the illustrated example, the forming unit 206 includes a top roll 304, which further includes an example lower portion 306, an example upper portion 308, and an example rounded surface 310 disposed between the lower portion 306 and the upper portion 308. The forming unit 206 further includes an example top roll adjustor 312, an example tensioning screw 314, an example side roll 316, an example bottom roll 318, an example first cam follower 320, an example second cam follower 322, example pins 324, and an example laser eye 326.

The top roll 304 engages a component (e.g., the component 202 of FIG. 2) during the roll-forming process. In some examples, the top roll 304 engages a top surface of the component 202 (e.g., a surface of the component 202 opposite the example stand 204 of FIG. 2). The top roll adjustor 312 adjusts a position and/or an angle of the top roll 304 during operation of the forming unit 206. In some examples, the top roll adjustor 312 is a servo (e.g., a servomechanism). In the illustrated example, the top roll adjustor 312 is adjusted by a spring, the tension of which is controlled by the example tensioning screw 314. The tensioning screw 314 can be turned to increase or decrease spring tension of the top roll adjustor 312, changing a position of the top roll 304. For example, the tensioning screw 314 can be adjusted to raise or lower the top roll 304 to accommodate a change in thickness of the component 202. In some examples, the top roll adjustor 312 utilizes an actuator. In some examples, the top roll adjustor 312 is adjusted to maintain a specific load of the top roll 304 on the component 202 (e.g., instead of maintaining a specified position). Additionally or alternatively, the top roll adjustor 312 (e.g., an actuator) is set to maintain a specified position of the top roll 304 unless a predetermined load is exceeded, in which case the top roll 304 is adjusted by the top roll adjustor 312 to move away from the specified position to decrease the load, preventing damage to the component 202 and/or the forming unit 206.

In the illustrated example, the lower portion 306 and the upper portion 308 of the top roll 304 are saucer shaped, having a diameter that is larger at the middle of the top roll 304 than at the lower edge (e.g., of the lower portion 306) and the upper edge (e.g., of the upper portion 308). The rounded surface 310 is disposed in the top roll 304 at the intersection of the lower portion 306 and the upper portion 308. In some examples, the rounded surface 310 contacts the component 202 to aid in forming a contour, bend, and/or fold in the component 202. For example, during operation, the rounded surface 310 can contact the component 202 where the contour, bend, and/or fold is to appear in the component 202, and the component 202 is bent around the rounded surface 310 (e.g., a crease is formed in the component 202 where the rounded surface 310 comes in contact with the component 202).

The side roll 316 is a generally cylindrical work roll that engages the component 202 at a desired angle (e.g., the forming angle). In some examples, the side roll 316 engages the component 202 on a surface of the component 202 opposite the surface engaged by the top roll 304 (e.g., a surface of the component 202 in contact with the stand 204, a bottom surface of the component 202, etc.). The side roll 316 applies a force to the component 202 to form a contour, bend, and/or fold in the component 202 (e.g., by bending the component 202 at the rounded surface 310). The forming unit 206 of the illustrated example further includes a side roll adjustor (e.g., shown in connection with FIG. 4C) to adjust a position and/or angle of the side roll 316. In some examples, the side roll adjustor is a servo (e.g., a servomechanism). In some examples, the side roll adjustor is a spring. Additionally or alternatively, the side roll adjustor can be an actuator or any other device capable of controlling a position or load of the side roll 316. In some examples, the side roll adjustor enables the side roll 316 to rotate between 0° and 110° during operation of the forming unit 206 (e.g., relative to a horizontal plane, such as the web 102 of FIGS. 1A and/or 1B). In some examples, the side roll adjustor enables the side roll 316 to rotate further than 110° relative to a horizontal plane during operation of the forming unit 206.

The forming unit 206 of the illustrated example further includes the bottom roll 318. The bottom roll 318 engages a bottom surface of the component 202 (e.g., the surface in contact with the stand 204). In operation, the bottom roll 318 rotates to move the component 202 through the forming unit 206. In some examples, the bottom roll 318 is fixed during operation of the forming unit 206. The bottom roll 318 further serves to apply a force to the bottom surface of the component 202, counteracting the forces applied to the top surface of the component 202 (e.g., applied by the top roll 304) to maintain a vertical position (e.g., in the orientation of FIG. 3) of the component 202. The top roll 304 and the bottom roll 318 are set to be separated by a distance (e.g., a vertical distance) approximately equal to the thickness of the component 202. Additionally or alternatively, the top roll 304 and the bottom roll 318 can be set to be separated by a distance that is about 5% to about 10% less than the thickness of the component 202 to, for example, maintain traction between the top roll 304 and the bottom roll 318 and the component 202. In other examples, other suitable percentages may be used. In operation, the top roll 304 and the bottom roll 318 pinch or squeeze the component 202 to maintain the position (e.g., to prevent lateral motion) of the component 202 when the force is applied by the side roll 316. Thus, the side roll 316 can apply the force to cause, for example, a bend in the component 202 without the force moving the component away from the side roll 316.

The angular position of the side roll 316 determines a forming angle (e.g., the angle of the contour, bend, and/or fold that is formed in the component 202 during a pass of the forming unit 206 along the component 202). For example, at the beginning of the roll-forming process, a flat (e.g., horizontal) component 202 is driven through the forming unit 206 by the top roll 304 and the bottom roll 318. The side roll 316 engages a side surface (e.g., a thin surface generally perpendicular to the top surface) and/or the bottom surface at a specific forming angle used for a first pass. In some examples, the forming angle of a first pass is small (e.g., 10°, 15°, etc.). For example, the forming angle is relatively small (e.g., 10°) so as to not apply too great of a force on the component 202, as large forces during a pass can lead to unwanted defects during the roll-forming process (e.g., bow, twist, etc.) and/or can produce high levels of stress and strain on the component 202. As the forming unit 206 continues to pass over the component 202 (e.g., in subsequent passes), the forming angle set by the side roll 316 increases, incrementally adjusting the shape of the component 202 into the correct profile (e.g., the constant cross-section component 100 of FIG. 1A, the variable cross-section component 106 of FIG. 1B, etc.). The changing of the forming angle in each pass throughout the forming process is referred to herein as a forming angle progression.

The forming unit 206 of the illustrated example further includes the first cam follower 320 and the second cam follower 322 located upstream and downstream of the forming unit 206, respectively. During operation of the forming unit 206, the first cam follower 320 and the second cam follower 322 prevent a peripheral edge of the component 202 (e.g., an edge furthest from the example central axis 214 of FIG. 2) from sinking or sagging below a horizontal plane of the example web 102. For example, when the component 202 is wide or includes a wide section (e.g., the second end 110 of the variable cross-sectional component 106 of FIG. 1B), the peripheral edge of the component 202 may begin to sink due to the weight of the component 202. The first and second cam followers 320,322 maintain the position (e.g., a vertical position) of the peripheral edge of the component 202 so that the component 202 (e.g., the web 102) remains in a single horizontal plane.

In some examples, the second cam follower 322 includes a brush that prevents galvanization buildup on the component 202. For example, the brush of the second cam follower 322 is in contact with the component 202 as the forming unit 206 makes a pass along the component 202 to sweep away any galvanization that builds up on the surface of the component 202. The brush may also be configured to contact the bottom roll 318 to maintain the proper surface texture of the bottom roll 318. Build up of galvanization on a surface of the bottom roll 318 may cause scratching of a surface of the component 202 if the build up of galvanization creates asperities on the surface of the bottom roll 318. Alternatively, build up of galvanization may reduce the friction between the bottom roll 318 and the component 202, causing a loss of drive capabilities. For example, the build up of galvanization can fill the asperities in the surface of the bottom roll 318 and make the surface of the bottom roll 318 relatively smoother.

The first cam follower 320 further includes pins 324 used to locate the component 202 to facilitate proper alignment of the forming unit 206 with the component 202. In some examples, the first cam follower 320 includes guides, switches, and/or other edge detection or location elements in place of the pins 324. For example, the pins 324 locate a corner of the component 202 so that the forming unit 206 can feed the component 202 through the top roll 304 and bottom roll 318 and maintain proper alignment with the side roll 316. In some such examples, the alignment of the side roll 316 with the component 202 when the forming unit 206 engages the component 202 prevents defects, such as flare, that can occur due to the slapping effect (e.g., deflection of the component 202 when the component 202 is first engaged by the forming unit 206 and caused by misalignment of the side roll 316 and the component 202). In some examples, the pins 324 are used for a component that has been precut (e.g., a blank). In some examples, the forming unit 206 includes a separating tool or a cutting tool (e.g., a laser cutter, a plasma cutter, etc.) that cuts the component 202 into the desired shape. In such examples, the forming unit 206 does not include the pins 324 and instead replaces the pins 324 with the separating tool.

The forming unit 206 of the illustrated example further includes the example laser eye 326. The laser eye 326 enables tracking of the movement of the forming unit 206 throughout the forming process. For example, the laser eye 326 can determine a position of the forming unit 206 as the forming unit 206 makes a pass along the component 202, and, when a defect occurs, the laser eye 226 can provide information regarding the position of the forming unit 206 when the defect occurred. Such feedback allows the controller 208 to make adjustments to the positions and/or angles of the forming unit 206, the top roll 304, the side roll 316, and/or the bottom roll 318 during the forming process and/or after forming of the component 202 is completed (e.g., the adjustments are made for a subsequent component or subsequent passes of the current component to correct the defect).

The forming unit 206 can additionally be adjusted to orient the forming unit 206. For example, for a given component profile, the forming unit 206 can be positioned at specified coordinates (e.g., X-Y-Z Cartesian coordinates) and a specified angle (e.g., angles about each of the x-axis, y-axis, and z-axis), the bottom roll 318 can be driven at a set position and angle, the top roll 304 can be positioned based on the thickness of the component 202 (e.g., leaving a distance between the top roll 304 and the bottom roll 318 equivalent to the thickness of the component 202 or some percentage of the thickness, such as, for example, 5-10% under the thickness of the component 202), and the side roll 316 can be adjusted to create the desired forming angle for the pass. During a subsequent example pass, the bottom roll 318 and the top roll 304 can remain in the same position, while the angle the side roll 316 is increased to increase the forming angle. In such an example, the subsequent pass increases the angle of the bend in the component 202.

In some examples, the controller 208 determines the forming angle and the positions and/or angles of the forming unit 206, the top roll 304, the side roll 316, and/or the bottom roll 318. In some examples, the controller 208 determines a number of passes the forming unit 206 is to make over the component 202. Further, the controller 208 can determine the positions and/or angles of the forming unit 206, the top roll 304, the side roll 316, and/or the bottom roll 318 for each individual pass (e.g., the forming angle progression) prior to initiating the forming process. In some examples, the controller 208 can receive inputs entered into one or more of the input devices 212 of FIG. 2 and use the inputs to determine the number of passes and/or positions for each pass.

Additionally or alternatively, the controller 208 can use data (e.g., sensor data from the example sensors 210) during operation to adjust the number of passes and/or positions for subsequent passes based on sensor feedback. For example, if the sensors 210 provide data to the controller 208 indicating that a defect occurred due to a forming angle that was too large (e.g., in a first pass), the controller 208 can increase a number of passes, decrease a forming angle, decrease a speed of the pass, and/or a make any combination of these adjustments. In some examples, such adjustments are made using machine learning techniques implemented by the controller 208. The adjustments of the controller 208 are disclosed further in connection with FIG. 9.

In some examples, the forming units 206 remain stationary while the component 202 is moved through the forming units 206 (e.g., by the feed rolls, robotic arms, etc.) to form a component profile. For example, the controller 208 can adjust the top roll 304, the side roll 316, and/or the forming unit 206 as the component 202 moves through the forming unit 206. In some such examples, the forming unit 206 does not move along a length of the component 202 when the component 202 moves through the forming unit 206.

Figure 4B:
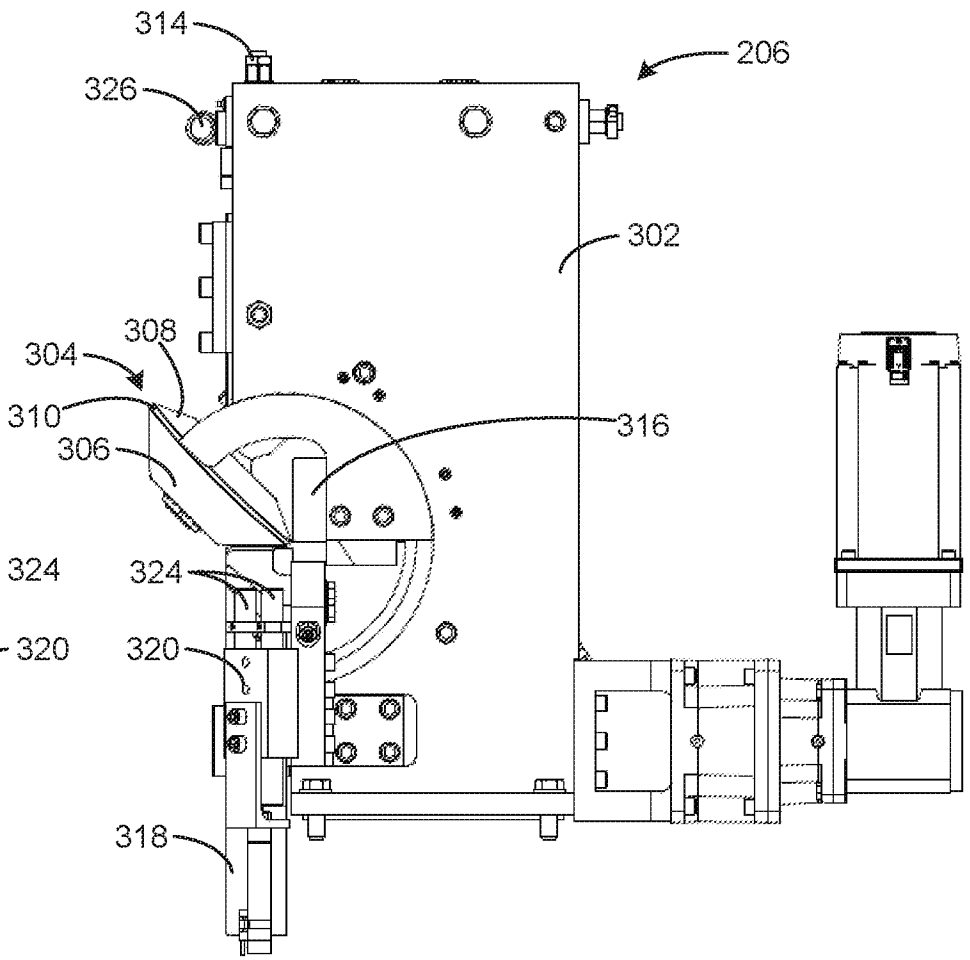
FIG. 4B is a side view of the example forming unit of FIG. 3.
Figure 4A:
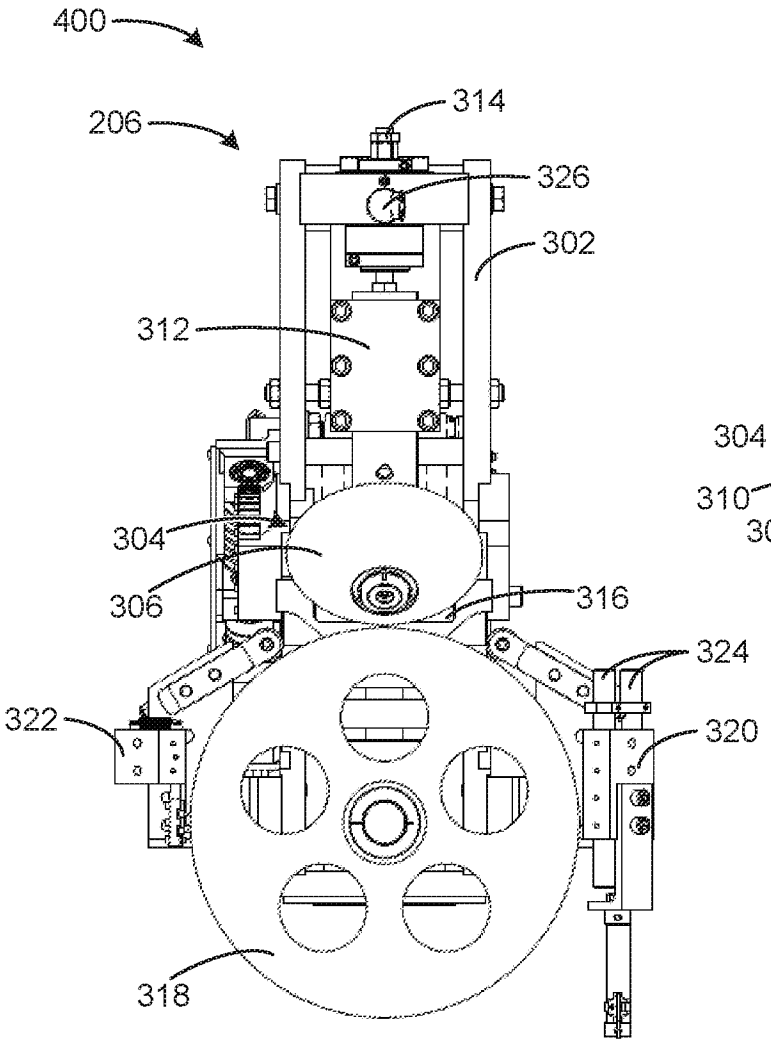
FIG. 4A is a front view of the example forming unit of FIG. 3.

FIG. 4A is a front view 400 of the example forming unit 206 of FIG. 3. The front view shown in FIG. 4A shows the interface between the top roll 304 and the bottom roll 318. When the forming unit 206 passes along a component (e.g., the component 202 of FIG. 2), the component 202 is passed between the top roll 304 and the bottom roll 318. In some examples, the component 202 is moved by the bottom roll 318 (e.g., the component 202 moves from right to left in the orientation of FIG. 4A).

The illustrated example of FIG. 4A further includes the first cam follower 320 and the second cam follower 322. During a pass of the forming unit 206 over the component 202, the first cam follower 320 contacts the component 202 to keep the component 202 level (e.g., existing in a single horizontal plane in the orientation of FIG. 4A) as the component 202 reaches the interface between the top roll 304 and the bottom roll 318. In some examples, wherein the component 202 is a blank (e.g., not separated by the forming unit 206), the pins 324 aid the forming unit 206 in locating the component 202 and aligning the top roll 304 and the bottom roll 318 with the component 202.

As the forming unit 206 makes a pass along the component 202, the component is fed through the top roll 304 and the bottom roll 318 and to the second cam follower 322 (e.g., right to left in the orientation of FIG. 4A). The second cam follower 322 receives the component 202 after the pass of the forming unit 206, and additionally aids in maintaining the vertical position (e.g., in the orientation of FIG. 4A) of the component 202. In some examples, the second cam follower 322 further includes a brush to remove excess galvanization buildup from the component 202 as the component 202 is fed through the forming unit 206.

FIG. 4B is a side view 402 of the example forming unit 206 of FIG. 3. The side view shown in FIG. 4B shows the interface between the top roll 304 and the side roll 316. For example, when the forming unit 206 passes along the component 202, the side roll 316 exerts a force on the component 202 as the component 202 is passed between the top roll 304 and the bottom roll 318. In the illustrated example of FIG. 4B, the forming angle created by the side roll 316 is approximately 90° (e.g., between the lower portion 306 and the side roll 316). In some examples, the rounded surface 310 of the top roll 304 serves as a joint (e.g., a point of rotation of the component 202). For example, the forming unit 206 can be performing a first pass along the component 202 to begin producing a leg (e.g., the legs 104 of FIGS. 1A and/or 1B), and, when the side roll 316 applies a force to the component 202, the component 202 bends at a point of contact (e.g., a point of rotation) between the component 202 and the rounded surface 310.

Figure 4C:
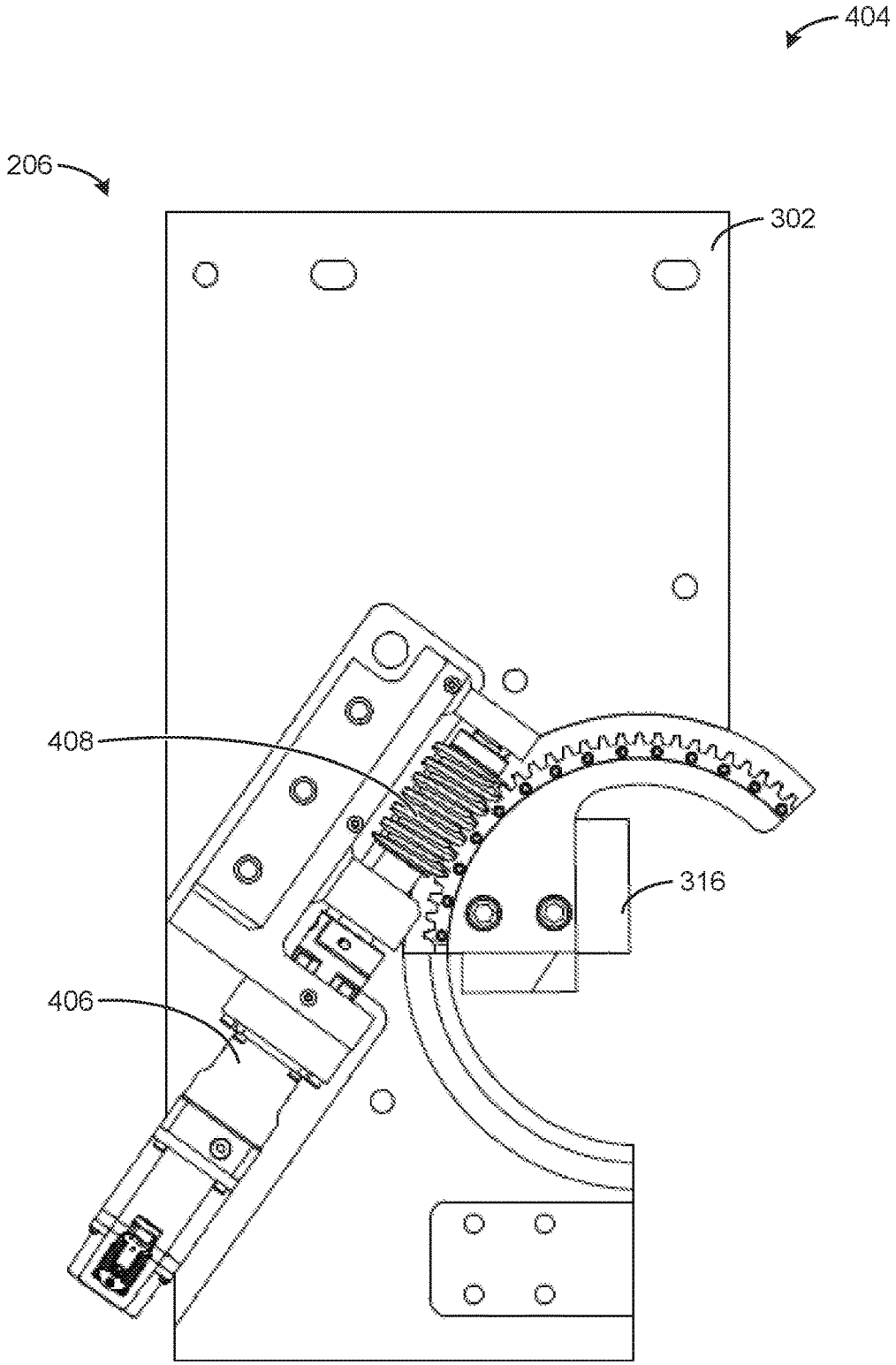
FIG. 4C is a simplified side view of the example forming unit of FIG. 3 displaying an example side roll adjustor.

FIG. 4C is a simplified side view 404 of the example forming unit 206 of FIG. 3 displaying an example side roll adjustor 406. For clarity, the simplified side view 404 does not show the other elements of the forming unit 206 shown and disclosed in connection with FIG. 3. The simplified side view 404 includes the example side roll adjustor 406 and an example worm gear 408 used by the side roll adjustor 406. In some examples, the side roll adjustor 406 adjusts a position and/or an angle of the side roll 316 by increasing or decreasing the location of teeth of the worm gear 408 by rotating a gear input journal of the worm gear 408. For example, to increase a forming angle for a pass of the forming unit 206, the side roll adjustor 406 can increase a rotation angle of the worm gear 408 to advance the teeth. Additionally or alternatively, the side roll adjustor 406 can adjust the position of the side roll 316 using an actuator or other device. In some examples, the side roll adjustor 406 adjusts the side roll 316 to maintain a predetermined load on a component (e.g., the component 202 of FIG. 2). In some examples, the side roll adjustor 406 is set to maintain a specified position of the side roll 316 unless a predetermined load is exceeded, in which case the side roll 316 is adjusted by the side roll adjustor 406 to move away from the specified position to decrease the load, preventing damage to the component 202 and/or the forming unit 206.

Figure 4E:
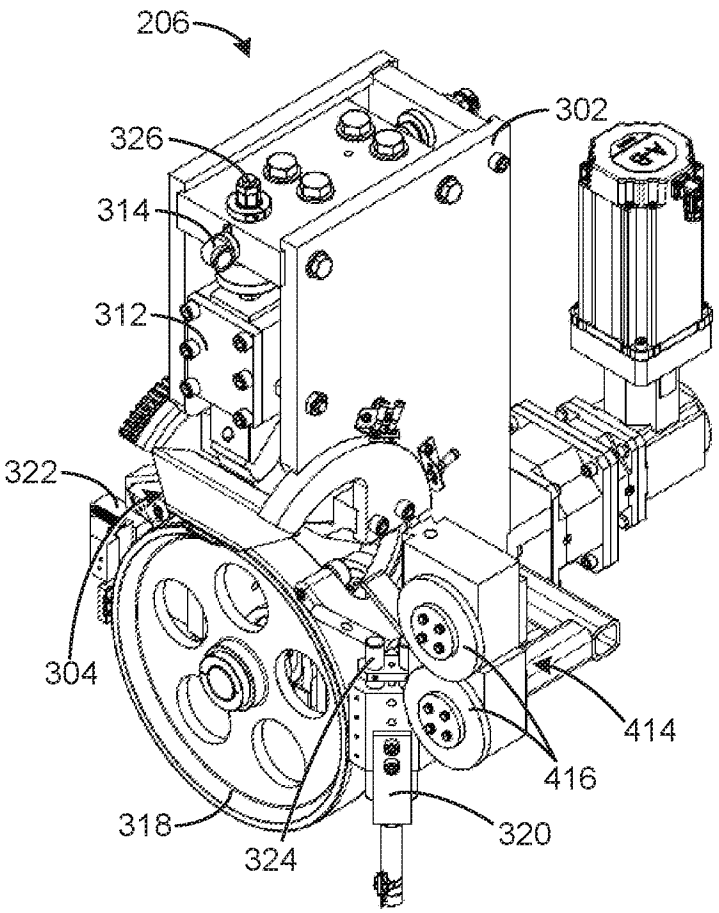
FIG. 4E is a schematic illustration of an example slitter operatively coupled to the example forming unit of FIG. 3.
Figure 4D:
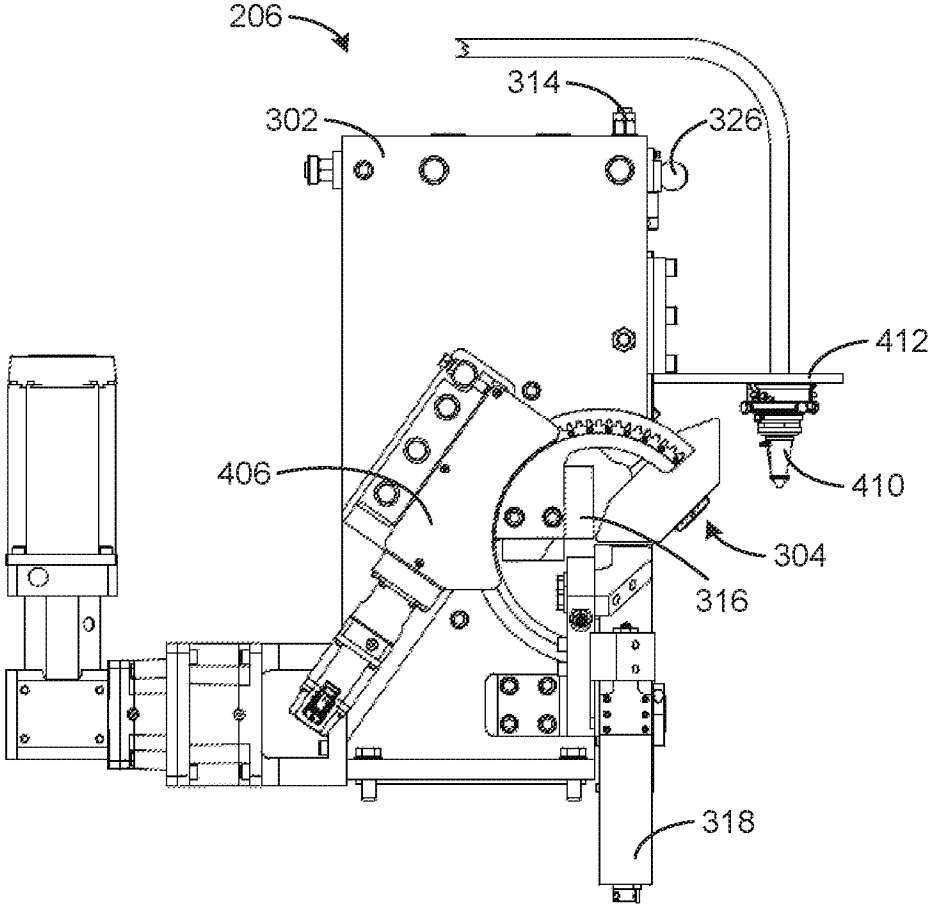
FIG. 4D is a side view of an example laser cutter operatively coupled to the example forming unit of FIG. 3.

FIG. 4D is a side view of an example laser cutter 410 operatively coupled to the example forming unit 206 of FIG. 3. The example laser cutter 410 is mounted to the example housing 302 of FIG. 3 of the forming unit 206 via a mount 412 (e.g., a bracket). In operation, the laser cutter 410 cuts a component (e.g., the component 202 of FIG. 2) using a laser. For example, a focused laser beam is directed at the component 202 by the laser cutter 410 to melt, burn, and/or vaporize material of the component 202 to form an edge in the component 202.

In some examples, a position of the forming unit 206 is adjusted to cut the component 202 using the laser cutter 410. For example, the forming unit 206 can move along the component 202 while focusing the laser cutter 410 on the component 202 to cut the component 202 into a desired shape and/or size. Further, in some examples, the forming unit 206 can move toward or away from the component 202 (e.g., toward or away from the example central axis 214 of the component 202) while cutting the component 202 with the laser cutter 410. By operatively coupling the laser cutter 410 to the forming unit 206, the forming unit 206 can cut the component 202 into the desired shape and/or size and promptly begin forming the component 202 (e.g., using the example side roll 316 of FIG. 3), reducing the overall time spent creating a desired profile in the component 202.

FIG. 4E is a schematic illustration of an example slitter 414 operatively coupled to the example forming unit of FIG. 3. The example slitter 414 includes slitting rolls 416 used to cut a component (e.g., the example component 202 of FIG. 2) into a desired size and/or shape. In operation, the slitting rolls 416 are used to cut a material using a shearing force. For example, the slitting rolls 416 can include matching ribs and/or grooves that are used to apply a shearing force to the component 202 as the slitting rolls 416 rotate, creating a precise cut in the component 202. In some examples, the slitter 414 is positioned by positioning the forming unit 206. For example, the forming unit 206 can move along the component 202 and can move toward or away from the example central axis 214 of FIG. 2 of the component 202 to form the component 202 into the correct size and/or shape. By operatively coupling the slitter 414 to the forming unit 206, the forming unit 206 can cut the component 202 into the desired shape and/or size and promptly begin forming the component 202 (e.g., using the example side roll 316 of FIG. 3), reducing the overall time spent creating a desired profile in the component 202. The example laser cutter 410 of FIG. 4D and/or the example slitter 414 of FIG. 4E can be used, for example, to cut the example curved cutout 124 of FIG. 1C.

Figure 5A:
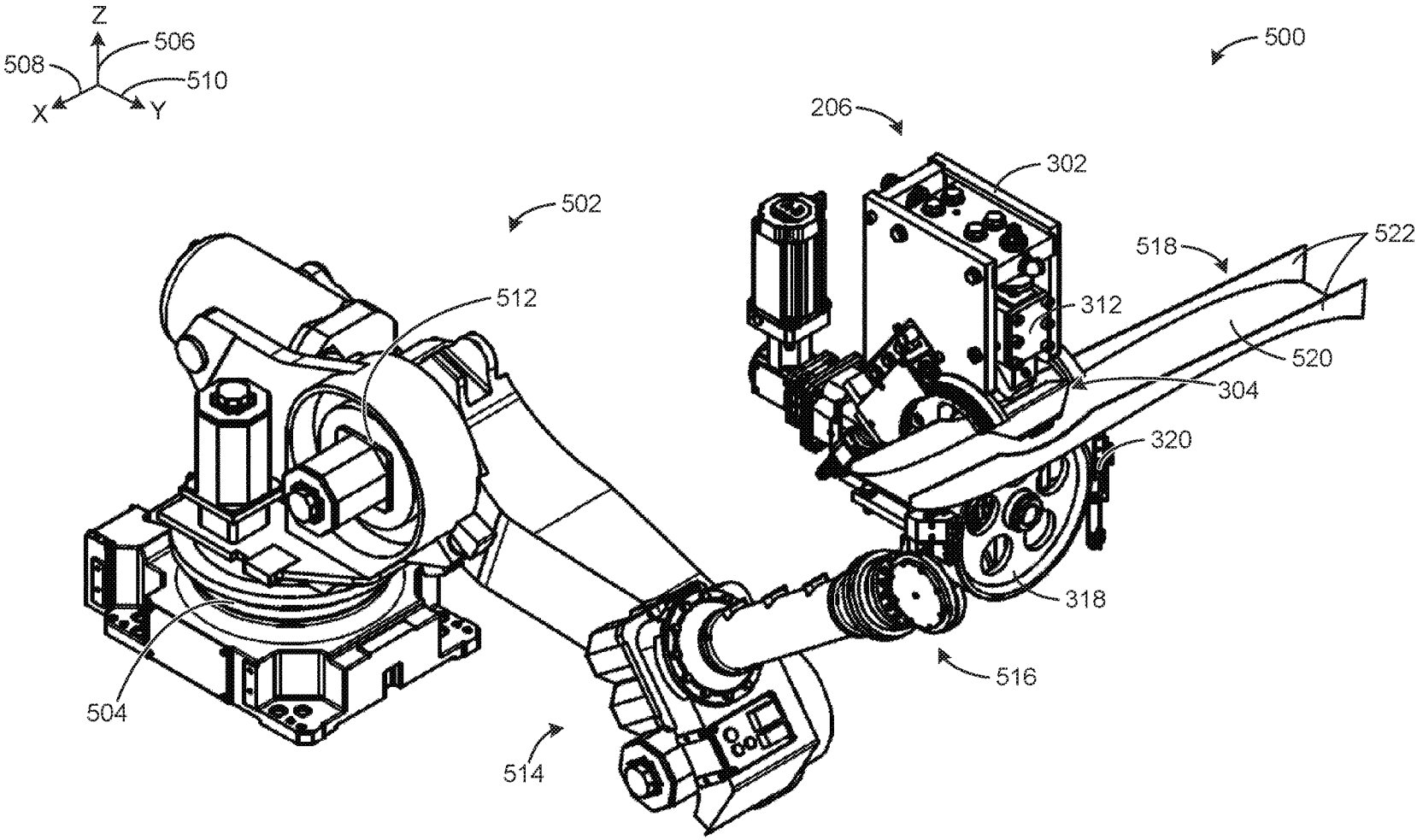
FIG. 5A is a schematic illustration of an example robotic forming unit assembly including the example forming unit of FIG. 3 operatively coupled to an example robot arm.

FIG. 5A is a schematic illustration of an example robotic forming unit assembly 500 including the example forming unit 206 of FIG. 3 operatively coupled to an example robot arm 502. In the illustrated example, the robot arm 502 is capable of rotation about a base joint 504. For example, the robot arm 502 can rotate about a z-axis 506 to rotate the robot arm 502 and the forming unit 206 disposed at a distal end of the robot arm 502. In some such examples, rotation of the base joint 504 about the z-axis 506 causes translation of the forming unit 206 along an x-axis 508 and/or a y-axis 510. In some examples, the base joint 504 is further capable of rotation about the x-axis 508 and/or the y-axis 510.

The robot arm 502 of the illustrated example further includes a first robot arm joint 512 capable of rotation about the x-axis 508. For example, rotation of the first robot arm joint 512 about the x-axis 508 can cause the forming unit 206 to translate along the z-axis 506 (e.g., moving the forming unit 206 up or down). In some examples, the first robot arm joint 512 is capable of rotation about the z-axis 506 and/or the y-axis 510. Further, the robot arm 502 includes an example second robot arm joint 514 capable of rotation about the z-axis 506, the x-axis 508, and/or the y-axis 510. In the illustrated example, the robot arm 502 further includes a third robot arm joint 516 capable of rotation about the z-axis 506, the x-axis 508, and/or the y-axis 510. The robot arm 502 thus uses the base joint 504, the first robot arm joint 512, the second robot arm joint 514, and/or the third robot arm joint 516 to cause the forming unit 206 to translate along the z-axis 506, the x-axis 508, and/or the y-axis 510, as well as to cause the forming unit 206 to rotate about the z-axis 506, the x-axis 508, and/or the y-axis 510. The forming unit 206, when operatively coupled to the robot arm 502, therefore has six degrees of freedom (e.g., rotation and translation about all axes 506-510).

In some examples, the forming unit 206 moves along an example curved component 518 to form a profile of the curved component 518. The curved component 518 represents another example component having a variable cross-section. For example, the curved component 518 includes a web 520 having a constant width along the length of the curved component 518. However, the web 520 is curved (e.g., not a flat plate) along the length of the curved component 518, and, further, example legs 522 of the curved component 518 vary in height along the length of the curved component 518.

In some examples, the robot arm 502 positions the forming unit 206 and/or moves the forming unit 206 along the curved component 518. For example, the base joint 504 can rotate about the z-axis 506 to cause the forming unit 206 to move in the direction of the x-axis 508, while the third robot arm joint 516 rotates about the z-axis 506 to maintain the orientation of the forming unit 206 to the curved component 518. Simultaneously, in such an example, the first robot arm joint 512 rotates about the x-axis 508 to extend the robot arm 502 as the forming unit 206 moves along the curved component 518, and the second robot arm joint 514 further rotates about the x-axis 508 to maintain the forming unit 206 at a proper height (e.g., to keep the height constant as the forming unit 206 moves along the curved component 518). Additionally or alternatively, the robot arm 502 can operate using techniques similar to those used in this example to position the forming unit 206 to form any profile that is desired for the curved component 518 (e.g., the component 202 of FIG. 2).

In the illustrated example, the curved component 518 has legs 522 that are formed in a positive direction along the z-axis 506 (e.g., upward in the orientation of FIG. 5A). In some examples, however, the robotic forming unit assembly 500 forms a feature of the curved component 518 in a negative direction along the negative z-axis 506 (e.g., downward in the orientation of FIG. 5A). For example, the third robot arm joint 516 can rotate the forming unit 206 approximately 180° about the y-axis 510. The robot arm 502 can therefore position the forming unit 206 so that the bottom roll 318 engages a top surface of the curved component 518, and the top roll 304 and the side roll 316 form one of the legs 522 downward (e.g., relative to the web 520). In such examples, the forming angle of the example side roll 316 of FIG. 3 is inverted (e.g., flipped about a horizontal axis). Such a method would be useful, for example, when forming the asymmetric cross-section component 112 of FIG. 1C, where the example first leg 116 of FIG. 1C is formed upward, and the example second leg 118 of FIG. 1C is formed downward. The robotic forming unit assembly 500 would thus form the first leg 116 in the orientation shown in FIG. 5A and form the second leg 118 by rotating the forming unit 206 approximately 180° about the y-axis 510.

Further, in some examples, the robot arm 502 is capable of translation along the curved component 518. For example, the robot arm 502 can be mounted on the example parallel track 216 of FIG. 2 to translate while maintaining the ability to rotate the base joint 504, the first robot arm joint 512, the second robot arm joint 514, and/or the third robot arm joint 516. In such examples, the robotic forming unit assembly 500 can form large sections of the curved component 518 and/or form the profile along the entire length of the curved component 518.

In some examples, the controller 208 of FIG. 2 is implemented by the forming unit 206. In some such examples, the controller 208 is communicatively coupled to the robot arm 502 and provides instructions to the robot arm 502 to properly position the forming unit 206 relative to the component 202. For example, for a desired profile of the curved component 518, the controller 208 can instruct the robot arm 502 how to move the base joint 504 and the robot arm joints 512-516 to position the forming unit 206 for each pass over the curved component 518. In some such examples, the position of the forming unit 206 is adjusted for each pass over the curved component 518 to gradually form the profile in the curved component 518. The controller 208 therefore provides the amount of rotation of the base joint 504 and the robot arm joints 512-516 prior to and during passes of the forming unit 206 over the curved component 518.

In some examples, the roll-forming assembly 200 of FIG. 2 includes multiple robotic forming unit assemblies 500 that respectively form different areas of the curved component 518. For example, the roll-forming assembly 200 can include a robotic forming unit assembly 500 to form each leg (e.g., the legs 104 of FIG. 1) of the curved component 518. In some examples, the four forming units 206 of FIG. 2 can be operatively coupled to robot arms 502 to operate as disclosed above.

Figure 5B:
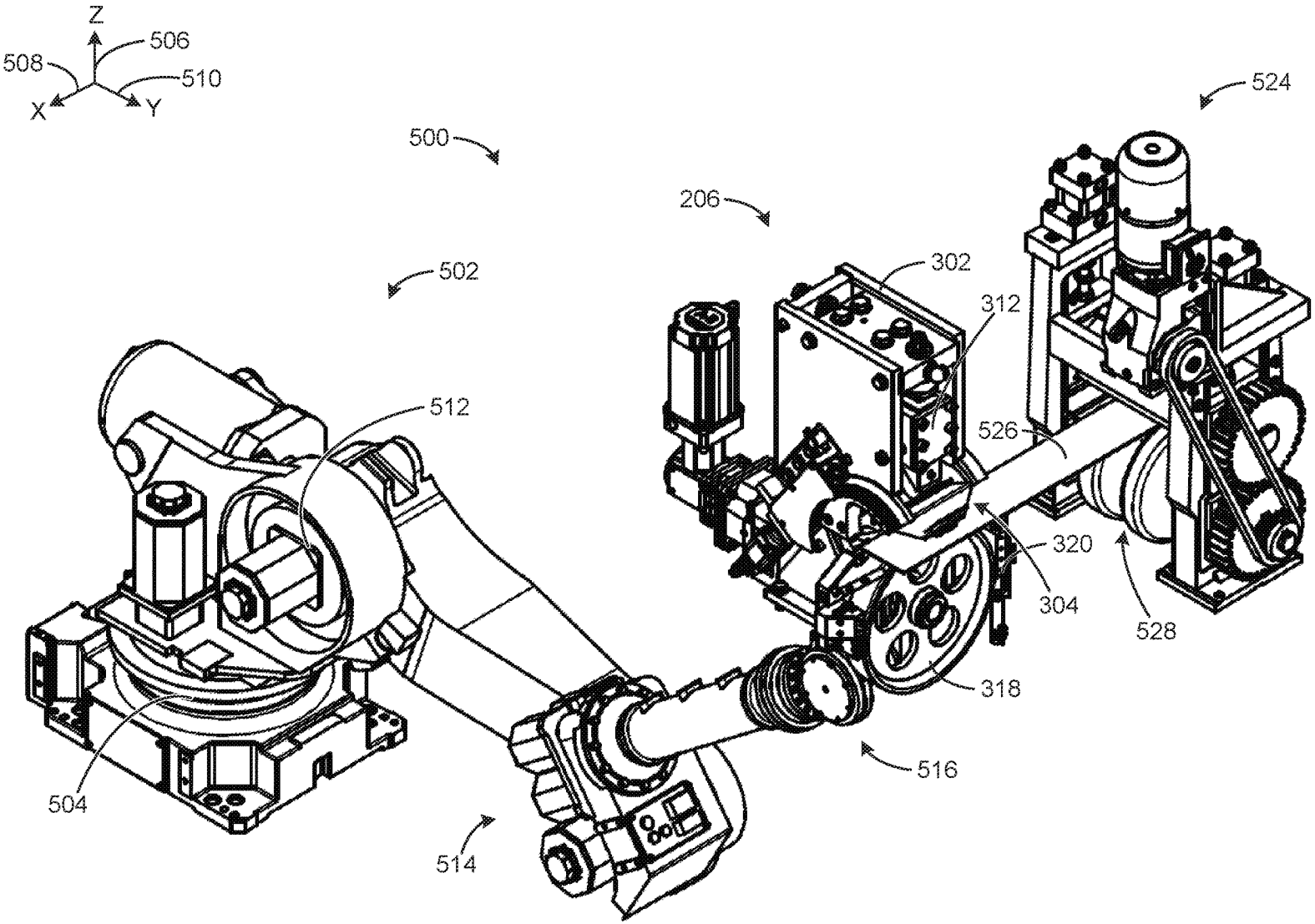
FIG. 5B is a schematic illustration of the example robotic forming unit assembly of FIG. 5A further including an example feed roll system.

FIG. 5B is a schematic illustration of the example robotic forming unit assembly 500 of FIG. 5A further including an example feed roll system 524. In the illustrated example, the forming unit 206 is held stationary by the robot arm 502, and the feed roll system 524 moves an example component 526 through the forming unit 206. For example, the feed rolls 528 can grip the component 526 and rotate to move the component 526 toward the forming unit 206. In such an example, a pass is defined as movement of the component 526 through the forming unit 206. In some examples, the component 526 makes multiple passes through forming units 206, which form a desired profile in the component 526. For example, the side roll 316 of FIG. 3 can apply a force at a specified angle (e.g., specified by the controller 208 of FIG. 2) to form the component 526 during a pass of the component 526 through the forming unit 206.

In some examples, the robot arm 502 adjusts an angle of the forming unit 206 relative to the component 526 as the feed rolls 528 move the component 526 toward the forming unit 206. Further, in some examples, the robot arm 502 moves the forming unit 206 along the y-axis 510 to change a position of the forming unit 206 relative to a width of the component 526. However, in the illustrated example, the forming unit 206 does not move along the length of the component 526 (e.g., along the example x-axis 508) during the forming process.

Figure 6:
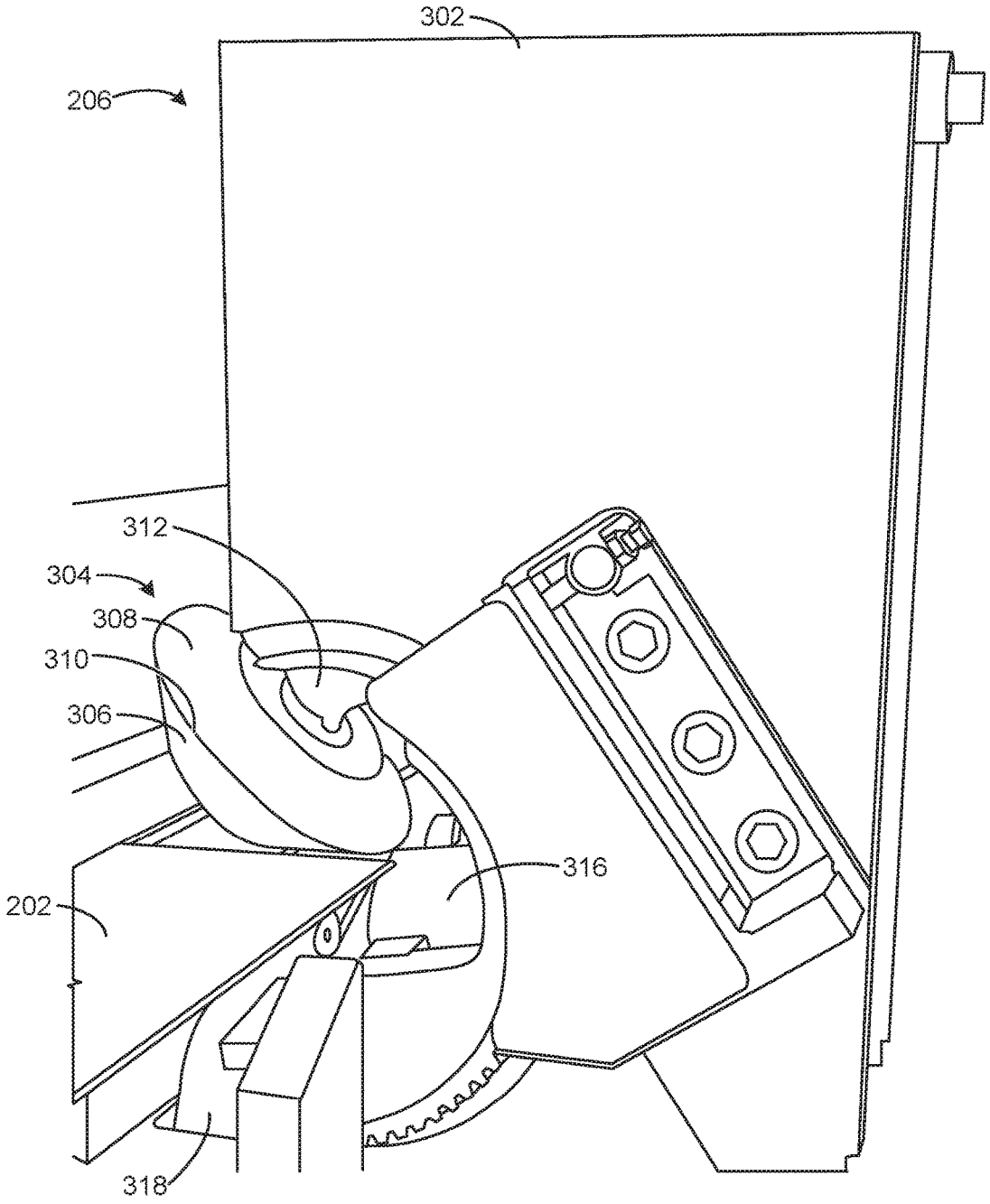
FIG. 6 is an isometric view of the example forming unit of FIG. 3 at a beginning of a roll-forming process.

FIG. 6 is an isometric view of the example forming unit 206 of FIG. 3 at a beginning of a roll-forming process. The example component 202 of FIG. 2 is shown approaching the example top roll 304 and the example side roll 316 of the forming unit 206. The component 202 is shown as a flat material (e.g., a flat piece of sheet metal) that has not yet begun the roll-forming process. In the illustrated example, the bottom roll 318 is to facilitate movement of the component 202 through the forming unit 206 (e.g., the top roll 304 and the side roll 316). Additionally or alternatively, the forming unit 206 can move toward the component 202 (e.g., using the parallel track 216 of FIG. 2, the robot arm 502 of FIG. 5A, etc.) and engage the component 202 with the top roll 304, the side roll 316, and/or the bottom roll 318.

In the illustrated example, the lower portion 306 of the top roll 304 engages the material at an angle such that the lower portion 306 is to be flush with a top surface of the component 202. The side roll 316 is to engage a bottom surface of the component 202 (e.g., opposite the top surface) at an angle such that the forming angle formed between the top roll 304 and the side roll 316 is relatively small (e.g., 10°). In some examples, the forming angle is small to begin gradually, iteratively, and/or otherwise progressively bending the component 202. The top roll 304 and the bottom roll 318 provide support to the top surface and the bottom surface of the component 202, respectively, to stabilize the component 202 as forces are applied by the top roll 304 and the side roll 316 to begin bending the component 202.

Figure 7:
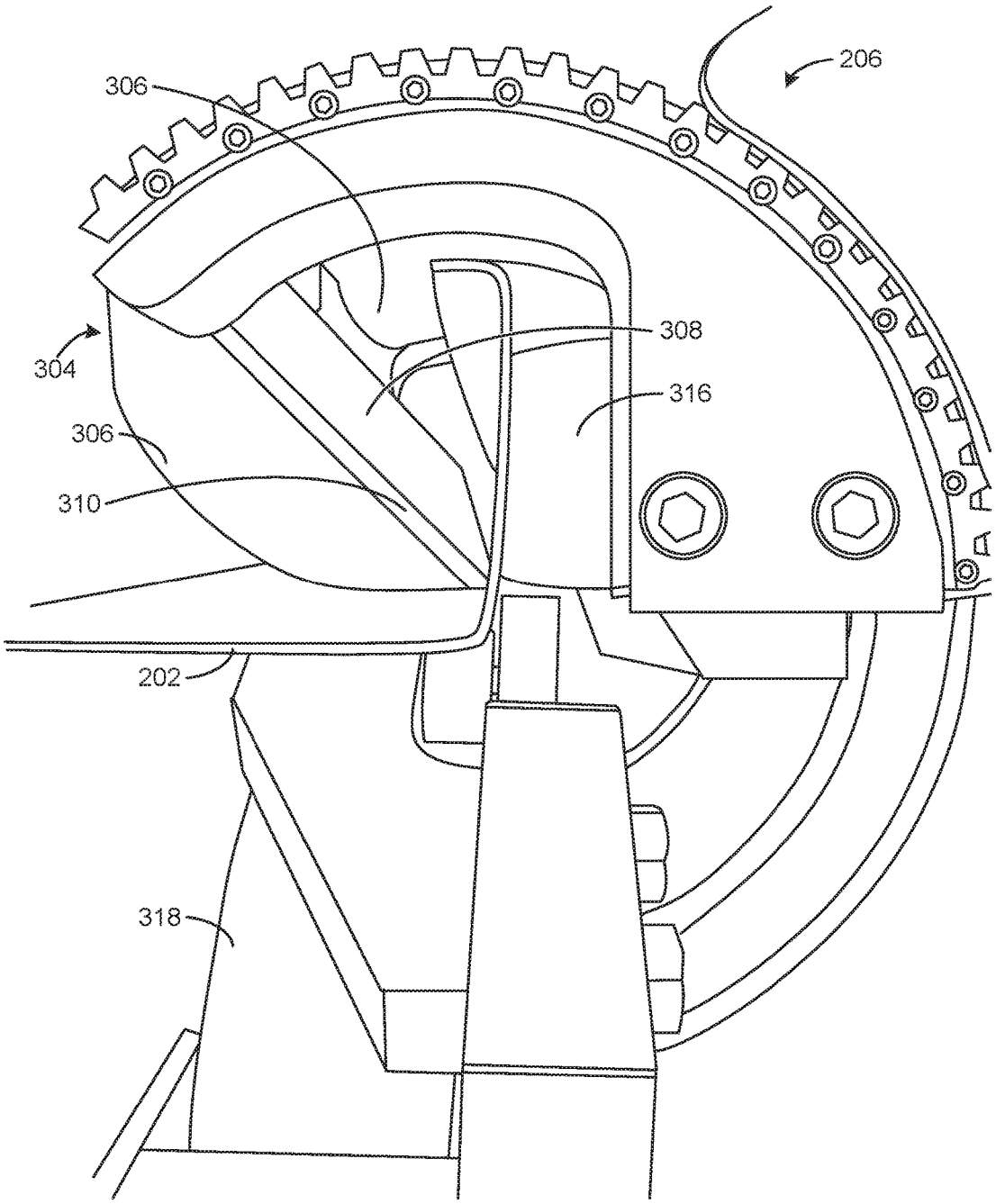
FIG. 7 is a downstream view of the example forming unit of FIG. 3 performing a final pass along the component.

FIG. 7 is a downstream view of the example forming unit 206 of FIG. 3 performing a final pass along the component 202. For example, in the downstream view of FIG. 7, the component 202 is exiting the forming unit 206 as the forming unit 206 completes a final pass along the component 202. The component 202 is engaged by the top roll 304, the bottom roll 318, and the side roll 316, which form the forming angle used during the final pass of the forming unit 206 along the component 202. The forming angle is created by an outer surface of the side roll 316 (e.g., approximately vertical in the orientation of FIG. 7). The rounded surface 310 contacts the component 202 along an edge or crease of a bend or fold in the component 202.

Figure 8:
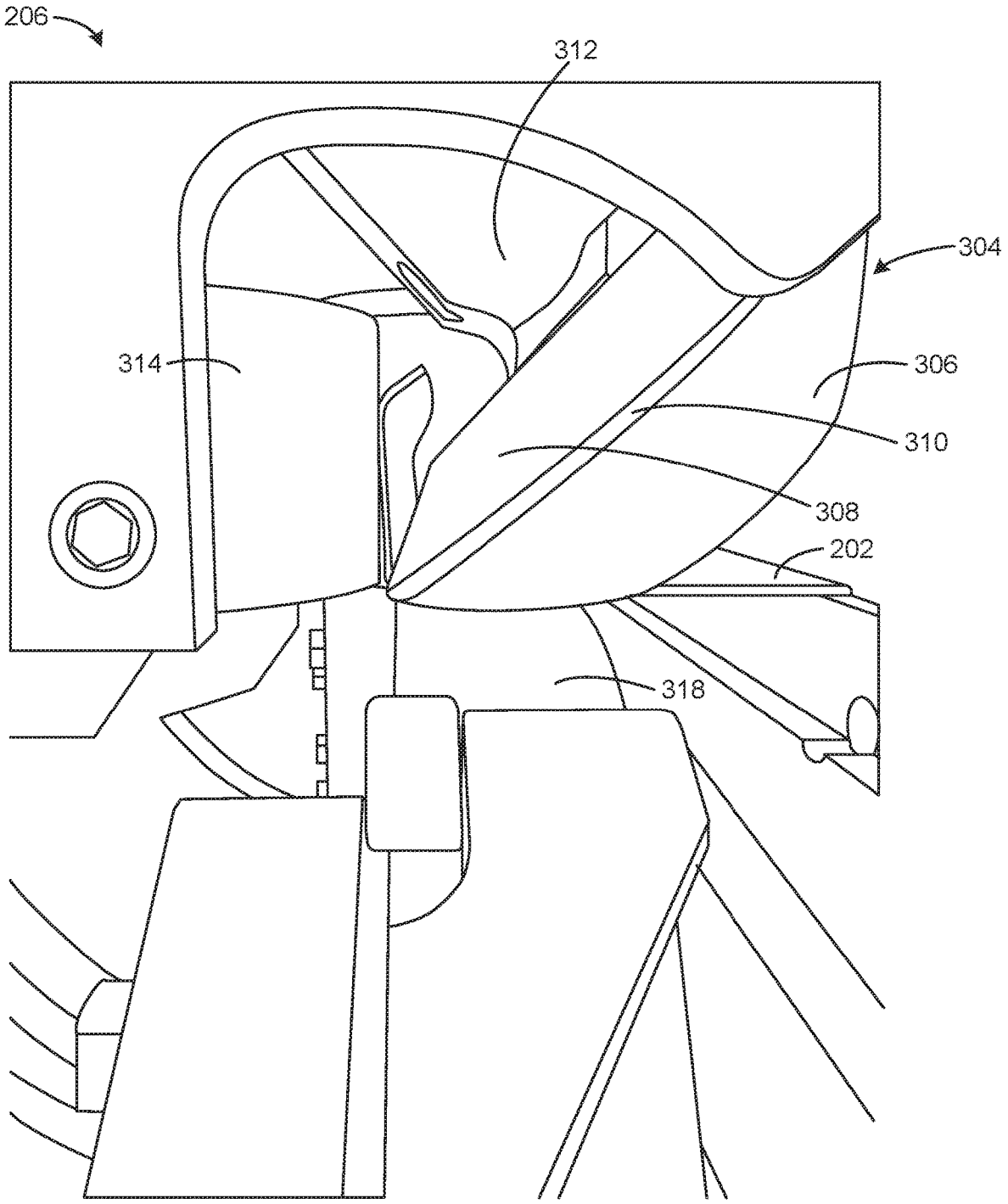
FIG. 8 is an upstream view of the example forming unit of FIG. 3 having completed forming an example component.

FIG. 8 is an upstream view of the example forming unit 206 of FIG. 3 having completed forming the example component 202. In the illustrated example, the upstream view of FIG. 8 shows the completed component 202 after the forming unit 206 has performed a final pass over the component 202. The component 202 therefore has the desired profile and the forming unit 206 can begin forming the next component 202. The side roll 316 is positioned in the final forming angle of the forming progression (e.g., approximately 90° or vertical). In the illustrated example, the rounded surface 310 indicates where a corner or crease was formed in the component 202. Further, an interface between the top roll 304 (e.g., the lower portion 306) and the bottom roll 318 indicates where the component 202 was urged through the forming unit 206 during the final pass.

Figure 9:
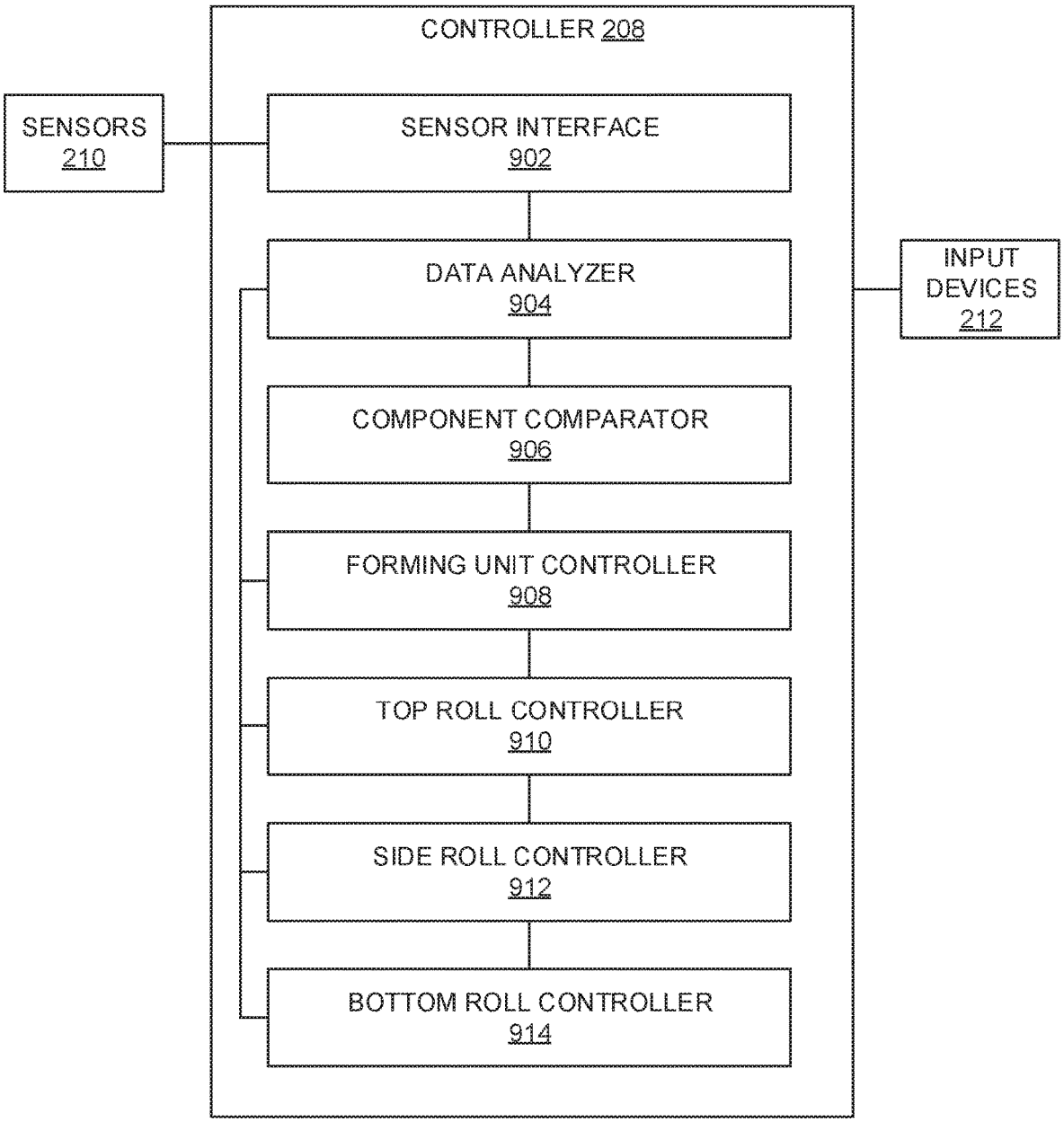
FIG. 9 is a block diagram of the example controller of FIG. 2.

FIG. 9 is a block diagram of the example controller 208 of FIG. 2. The controller 208 includes an example sensor interface 902, an example data analyzer 904, an example component comparator 906, an example forming unit controller 908, an example top roll controller 910, an example side roll controller 912, and an example bottom roll controller 914. The controller 208 is further communicatively coupled to the example sensors 210 of FIG. 2 and the example input devices 212 of FIG. 2.

In operation, the sensor interface 902 receives sensor data from sensors 210 included in the roll-forming assembly 200 of FIG. 2. For example, the sensor interface 902 receives data from a profilometer associated with the profile of the component 202. In some examples, the controller 208 further receives inputs from the input devices 212. For example, the input devices 212 can receive input from an operator to determine a profile and/or other parameters of the component 202. In some examples, the input devices 212 include one or more of a touch screen, a keyboard, a mouse, a computer, a microphone, etc.

The sensor interface 902 is communicatively coupled to the data analyzer 904 and transmits the sensor data to the data analyzer 904. In some examples, the data received from the sensors 210 and data and/or instructions input from the input devices 212 are used by the data analyzer 904 to determine adjustments to the roll-forming assembly 200 of FIG. 2. For example, the input devices 212 can receive information associated with the desired profile to be used to form the component 202 and transmit this information to the controller 208. The data analyzer 904 receives the profile information and determines the position of the forming unit 206, the top roll 304, the side roll 316, the bottom roll 318, and/or other components of the forming unit 206 (e.g., slitting rolls, laser cutters, etc.). In some such examples, the data analyzer 904 determines the position of the forming unit 206, the top roll 304, the side roll 316, the bottom roll 318, and/or other elements of the forming unit 206 for each pass of the forming unit 206. Additionally or alternatively, the component 202 can move relative to the forming unit 206 or both the forming unit 206 and the component 202 can move during the roll-forming process.

The data analyzer 904 is further communicatively coupled to the forming unit controller 908, the top roll controller 910, the side roll controller 912, and the bottom roll controller 914. When the data analyzer 904 determines the position of the forming unit 206, the data analyzer 904 instructs the forming unit controller 908 to move the forming unit controller 908 into the desired position. In some examples, the forming unit controller 908 instructs the forming unit 206 to make a pass along the component 202 to apply forces (e.g., via the side roll 316) to the component 202, thus creating the desired profile. For example, the forming unit controller 908 can adjust an angle of the forming unit 206 relative to the component 202 to apply the force. In some such examples, the forming unit 206 adjusts the position of the forming unit 206 relative to a central axis (e.g., the central axis 214 of FIG. 2) of the component 202 during a pass of the forming unit 206 (e.g., to form a variable cross-section). In some examples, the forming unit controller 908 adjusts the position of the forming unit 206 when the forming unit 206 is operatively coupled to the parallel track 216 of FIG. 2.

The forming unit controller 908 of the illustrated example can further instruct a robot arm (e.g., the robot arm 502 of FIG. 5A) operatively coupled to the forming unit 206. The forming unit controller 908 can instruct the robot arm 502 to position the forming unit 206 via rotation of the base joint 504, the first robot arm joint 512, the second robot arm joint 514, and/or the third robot arm joint 516 of FIG. 5A. The forming unit controller 908 can instruct the robot arm 502 to adjust the position of the forming unit 206 prior to or during operation of the forming unit 206. For example, the forming unit controller 908 can instruct the robot arm 502 to move the forming unit 206 along a peripheral edge of the component 202. In some such examples, the forming unit 206 can further move the forming unit 206 toward or away from a central axis of the component 202 (e.g., the central axis 214) to form a variable cross-section (e.g., the cross-section of the variable cross-section component 106 of FIG. 1). Further, the forming unit controller 908 can change an angle of the forming unit 206 relative to the component 202. For example, between passes of the forming unit 206 along the component 202, the forming unit controller 908 can adjust the angle of the forming unit 206 to prepare for a subsequent pass wherein the forming unit 206 is to increase a forming angle to create a bend or fold in the component 202 at a greater angle (e.g., an increase from 10° to 20°).

The data analyzer 904 further provides information to the top roll controller 910. In the illustrated example, the top roll controller 910 controls the example top roll adjustor 312 operatively coupled to the top roll 304 to change the local position and/or local angle of the top roll 304. The top roll controller 910 determines adjustments to the local position and local angle of the top roll 304 within the forming unit 206. For example, the top roll controller 910 can adjust the top roll 304 into a determined local angle (e.g., relative to the forming unit 206) and position (e.g., relative to a default position of the top roll 304 within the forming unit 206) prior to a first pass of the forming unit 206 along the component 202. In one or more subsequent pass of the forming unit 206 along the component 202, the top roll controller 910 continues to adjust the position of the top roll 304 when necessary to facilitate a proper interface between the side roll 316 and the component 202 during the pass. The top roll 304 can therefore be adjusted throughout the roll-forming process as the cross-section of the component 202 is gradually, iteratively, and/or progressively changed into the desired final cross-section (e.g., a variable cross-section).

In the illustrated example, the side roll controller 912 controls the example side roll adjustor 406 of FIG. 4C operatively coupled to the side roll 316 to change the local position and/or the local angle of the side roll 316. For example, the data analyzer 904 receives information (e.g., from the sensors 210, from the input devices 212, etc.) regarding the thickness of the component 202 prior to the first pass of the forming unit 206. In such an example, the thickness of the component 202 determines the position of the top roll 304, and the top roll controller 910 moves and/or rotates the top roll 304 into the correct position based on the thickness of the component (e.g., about 5% to about 10% less than the thickness of the component 202, or other suitable percentages). For example, the top roll controller 910 moves the top roll 304 to a position that creates a space between the top roll 304 and the bottom roll 318 and/or the side roll 316 that will allow the component 202 to pass through without causing unwanted deformation and/or stress and strain to the component 202.

The side roll controller 912 of the illustrated example adjusts a local position and/or local angle of the side roll 316 within the forming unit 206. For example, the side roll controller 912 can adjust a local angle of the side roll 316 to adjust the forming angle of a given pass of the forming unit 206 along the component 202. The example side roll controller 912 receives information from the data analyzer 904 regarding a proper local position and/or local angle for each pass of the forming unit 206 along the component 202. For example, after each completed pass, the side roll controller 912 can adjust the local angle of the side roll 316 to update the forming angle between the top roll 304 and the side roll 316 to gradually, iteratively, and/or progressively alter the cross-section of the component 202.

In the illustrated example, the bottom roll controller 914 adjusts a speed at which the bottom roll 318 is rotating. For example, the bottom roll controller 914 can instruct a motor or other device to increase or decrease the speed of rotation of the bottom roll 318. An increase in speed can reduce total production time, while a decrease in speed can decrease an occurrence of defects. Thus, the data analyzer 904 instructs the bottom roll controller 914 of the desired speed of the bottom roll 318 based on the profile of the component 202. When the bottom roll controller 914 adjusts the speed of the bottom roll 318, the top roll controller 910 and the side roll controller 912 adjust the speed of the top roll 304 and the side roll 316, respectively, to the same speed as the bottom roll 318. Further, the speed of the forming unit 206 is increased by the forming unit controller 908 to match the speed of the top roll 304, the side roll 316, and/or the bottom roll 318.

Additionally or alternatively, the bottom roll controller 914 further adjusts the local position and/or local angle of the bottom roll 318. For example, the position of the bottom roll 318 can be adjusted in a vertical direction (e.g., a z-direction) to engage and/or release the component 202. In some such examples, the bottom roll controller 914 raises the bottom roll 318 to engage a bottom surface of the component 202 to create an interface between the component 202 and the forming unit 206. This interface ensures that the top roll 304 and the side roll 316, as well as any other accessories of the forming unit 206, can engage the component 202 at the desired location and at the desired angle. Further, the bottom roll 318 can be adjusted by the bottom roll controller 914 to a position that maintains the position of the component 202 (e.g., a keeps the component 202 level) while the forming unit 206 makes a pass along the component 202.

In some examples, the controller 208 also is configured, programmed, or otherwise structured to regulate a speed and a position of the forming unit 206. For example, a speed of translation of the forming unit 206 along a longitudinal axis of travel (e.g., movement of the forming unit 206 in a direction of the central axis 214 of FIG. 2) may be regulated to match a speed at which the bottom roll 318 is driven. Further, when multiple forming units 206 are forming the component 202 at the same time (e.g., making simultaneous passes), the speed of forming (e.g., a speed of the forming unit 206 relative to the component 202) and the position of the forming units 206 can be evaluated to avoid damaging the component 202 (e.g., when the forming units 206 move at different speeds along a same component) or collisions of the forming units 206 (e.g., by operating the forming units at different forming speeds, by positioning the forming units 206 too close together, etc.).

In some examples, the controller 208 creates features in the component 202 based on detection of an outer edge of the component 202. For example, the sensors 210 (e.g., a profilometer, an ultrasonic sensor, a capacitive sensor, an inductive sensor, etc.) can detect an outer edge of the component 202, and the forming unit 206 can form the profile of the component 202 using the outer edge as a reference point. In some such examples, when the sensors 210 detect the outer edge of the component 202, the data analyzer 904 determines a position of the forming unit 206 for a pass that will form a feature (e.g., the legs 104 of FIGS. 1A and 1B) at a specified distance from the outer edge to maintain consistency of the feature along the length of the component 202. In such examples, the feature formed by the forming unit 206 will have a consistent dimension along the component 202, regardless of whether the blank was cut correctly (e.g., regardless of whether an imperfection resulted from the cutting process prior to forming the component 202). In such examples, the controller 208 can reduce an amount of programming used to form the component 202 because the component can be formed with only a distance from the outer edge being specified. For example, the data analyzer 904 can provide information to the forming unit controller 908, the top roll controller 910, the side roll controller 912, and the bottom roll controller 914 that forms a correctly dimensioned feature, regardless of a width of the component 202 (e.g., the programming of the controller 208 to form the feature is universal to all component widths).

In some examples, a completed component 202 is analyzed by one or more sensors 210 (e.g., a profilometer) to determine whether the positions of the forming unit 206, the top roll 304, the side roll 316, and/or the bottom roll 318 were correct throughout the roll-forming process. For example, a profilometer can be operatively coupled to the forming unit 206 to measure parameters of a completed component 202. The component comparator 906 of the illustrated example compares the measured parameters to an acceptable range of values to determine whether the positions of the forming unit 206, the top roll 304, the side roll 316, and/or the bottom roll 318 and/or adjustments made by the forming unit controller 908, the top roll controller 910, the side roll controller 912, and/or the bottom roll controller 914 were correct (i.e., positioned to create the profile within an acceptable tolerance of the desired profile) during the roll-forming process. If the measured parameters are found to not be within the acceptable range, the component comparator 906 determines that new position and/or angle values are to be calculated by the data analyzer 904.

The data analyzer 904 thus calculates new positions and/or angles for the forming unit 206, the top roll 304, the side roll 316, and/or the bottom roll 318 based on the measured parameters that are found to not be within the acceptable range. For example, if a leg (e.g., the leg 104 of FIGS. 1A and 1B) is measured to be at an angle that is outside of the acceptable range (e.g., an acceptable range of 85° to 95°), the data analyzer 904 can determine that the top roll 304 and/or the side roll 316 are to be adjusted to increase or decrease the forming angle (e.g., depending on whether the measured angle is greater than or less than the acceptable range) during one or more of the passes of the forming unit 206 along the component 202. In an example in which the measured angle is less than the acceptable range, the side roll controller 912 can position the side roll 316 to increase the forming angle during one or more passes (e.g., a final pass). In an alternative example, if the measured angle is greater than the acceptable range, the side roll 316 is adjusted to decrease the forming angle during one or more passes (e.g., a final pass).

The component comparator 906 can determine that adjustments are to be made to the positions of the forming unit 206 and/or the forming rolls (e.g., the top roll 304, the side roll 316, and the bottom roll 318) due to any other defects and/or imperfections in the component 202. For example, a web (e.g., the web 102 of FIGS. 1A and 1B) of the component 202 can be too wide or not wide enough, the legs 104 can have a height that is above or below an acceptable range, additional or alternative bends, folds, and/or contours can have lengths and/or angles that are outside of the acceptable range, and/or a first end (e.g., the first end 108 of FIG. 1) and/or a second end (e.g., the second end 110 of FIG. 1) of a variable cross-section can have improper or otherwise undesired dimensions. The component comparator 906 can detect such defects or imperfections and cause the data analyzer 904 to calculate new positions and/or angles that are to be implemented by one or more of the forming unit controller 908, the top roll controller 910, the side roll controller 912, and the bottom roll controller 914.

Further, the component comparator 906 can make adjustments to the forming unit 206, the top roll 304, the side roll 316, and/or the bottom roll 318 during passes and/or between passes of a forming process. For example, the component comparator 906 can receive sensor data (e.g., from a profilometer) throughout a pass of the forming unit 206 and can determine whether adjustments are to be made while continuing that pass or for subsequent passes. Thus, the controller 208 can make adjustments dynamically as the component 202 is formed.

In some examples, the component comparator 906 determines a presence of a defect based on a single measurement. For example, the component comparator 906 can determine the presence of a bow-type defect in the component 202 based on a measurement of the profile in which the web 102 increases in height in the middle of the profile of the component 202. Additionally or alternatively, the component comparator 906 detects the presence of other defects, such as twist, buckle, and flare, by comparing measurements (e.g., from the profilometer) at different points along a length of the component 202 (e.g., points along the central axis 214 of FIG. 2). For example, the component comparator 906 can determine that a leg (e.g., the leg 104 of FIGS. 1A and/or 1B) is flaring outward (e.g., the end of the component 202 is wider than a point closer to the middle of the length of the component 202) or that the component 202 is twisting along the length of the component 202.

When the component comparator 906 determines the presence of a defect, either based on a single measurement or a comparison of measurements along the component 202, the data analyzer 904 can determine adjustments to subsequent passes of the forming unit 206. For example, if the component comparator 906 determines that an end of the component 202 (e.g., a point where the forming unit 206 first engages the component 202) experienced flare during the previous pass of the forming unit 206, the data analyzer 904 can use this determination to adjust the angle of the forming unit 206 and/or the side roll 316 during the following pass or a portion of the following pass (e.g., only a portion of the component 202 having the defect). By adjusting the forming unit 206 and/or the side roll 316, the forming angle, and thus the forming angle progression, is adjusted for the component 202 to correct the defect present in the component 202.

In some examples, the component comparator 906 detects a defect or imperfection during a pass along the component 202 and makes adjustments to the forming unit 206 and/or the side roll 316 during a pass of the forming unit 206 along the component 202. For example, shortly after the forming unit 206 begins a pass over the component 202, the component comparator 906 may determine that the forming angle of the pass is forming an angle that is incorrect (e.g., 88° instead of 90°). In response, the data analyzer 904 can provide a corrected forming angle (e.g., to the side roll controller 912), and the forming unit 206 can restart the pass to form the component 202 at the correct angle. Such a response from the controller 208 prevents the forming unit 206 from making an additional pass along the component 202 to correct the angle.

In some examples, the data analyzer 904 stores the change made to the forming angle progression, and, when the component comparator 906 determines that the altered forming angle progression removed the defect, the data analyzer 904 can use the improved forming angle progression when forming subsequent components. Similar corrections and/or adjustments can be made by the data analyzer 904 when the component comparator 906 determines the presence of other types of defects (e.g., buckle, twist, bow, etc.).

Further, the controller 208 can implement machine learning techniques to optimize the forming angle progression, a number of passes taken by the forming unit 206 to form the component 202, and/or the speed of each pass using closed-loop logic feedback. In some examples, the data analyzer 904 specifies a number of passes to be taken by the forming unit 206 to form a profile in the component 202. For example, the data analyzer 904 can determine that fewer passes are to be taken by the forming unit 206 (e.g., reducing the number of passes from nine passes to six passes). In such an example, the forming angle progression would additionally change (e.g., increasing the change in forming angle from 10° each pass using nine passes to 15° each pass using six passes). The component comparator 906 then measures the quality of the component 202 (e.g., number and type of defects, stress and strain on the component 202, etc.) to determine if the change in the number of passes, and therefore of the forming angle progression, improved production of the component 202 and/or caused a decrease in quality of the component 202. For example, because six passes would reduce production time, if no decrease in quality was detected, the process would be further optimized by changing from nine passes to six passes. On the other hand, if the quality of the component 202 was significantly reduced, the component comparator 906 would determine that reducing the number of passes from nine to six would not be optimal or otherwise advance the desired goals.

The data analyzer 904 can further adjust the speed of one or more passes of the forming unit 206. Increasing the speed of the passes decreases production time, but, in some examples, increases the number of defects present in the component 202. Accordingly, in this example, the data analyzer 904 increases the speed of the passes of the forming unit 206, and the component comparator 906 determines the presence of defects and/or measures other parameters of quality. The component comparator 906 can determine whether the increase in speed enhances the forming process for the given component profile by reducing production without increasing the presence of defects. For example, if the increase in speed leads to a greater number of defects, the component comparator 906 determines that the increase in speed does not enhance production of the component 202. However, if the increase in speed does not have a substantial impact on the number of defects present in the component 202, the component comparator 906 determines that the increase in speed does enhance production because the increase in speed reduces production time for each of the components 202. The data analyzer 904 can thus determine changes to the forming process based on the feedback from the component comparator 906 to determine the forming angle progression and/or the speed of each pass to enhance production. Such examples can lead to increased production (e.g., a maximum output of components by the roll-forming assembly 200 of FIG. 2) without increasing defects in the components 202 that require correction.

Human intervention is also permitted, such that operators recognizing defects that the sensors 210 do not locate can be allowed to prevent a reduction in the number of forming passes. Conversely, an operator override can be permitted such that parts with defects can be produced quickly if so desired, including, for example, in situations in which less tightly toleranced components are desired or requested.

While an example manner of implementing the controller of FIG. 2 is illustrated in FIG. 9, one or more of the elements, processes and/or devices illustrated in FIG. 9 may be combined, divided, re-arranged, omitted, eliminated and/or implemented in any other way. Further, the example sensor interface 902, the example data analyzer 904, the example component comparator 906, the example forming unit controller 908, the example top roll controller 910, the example side roll controller 912, the example bottom roll controller 914, and/or, more generally, the example controller 208 of FIG. 9 may be implemented by hardware, software, firmware and/or any combination of hardware, software and/or firmware. Thus, for example, any of the example sensor interface 902, the example data analyzer 904, the example component comparator 906, the example forming unit controller 908, the example top roll controller 910, the example side roll controller 912, the example bottom roll controller 914, and/or, more generally, the example controller 208 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example sensor interface 902, the example data analyzer 904, the example component comparator 906, the example forming unit controller 908, the example top roll controller 910, the example side roll controller 912, the example bottom roll controller 914, and/or the example controller 208 is/are hereby expressly defined to include a non-transitory computer readable storage device or storage disk such as a memory, a digital versatile disk (DVD), a compact disk (CD), a Blu-ray disk, etc. including the software and/or firmware. Further still, the example controller 208 of FIG. 2 may include one or more elements, processes and/or devices in addition to, or instead of, those illustrated in FIG. 9, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 10:
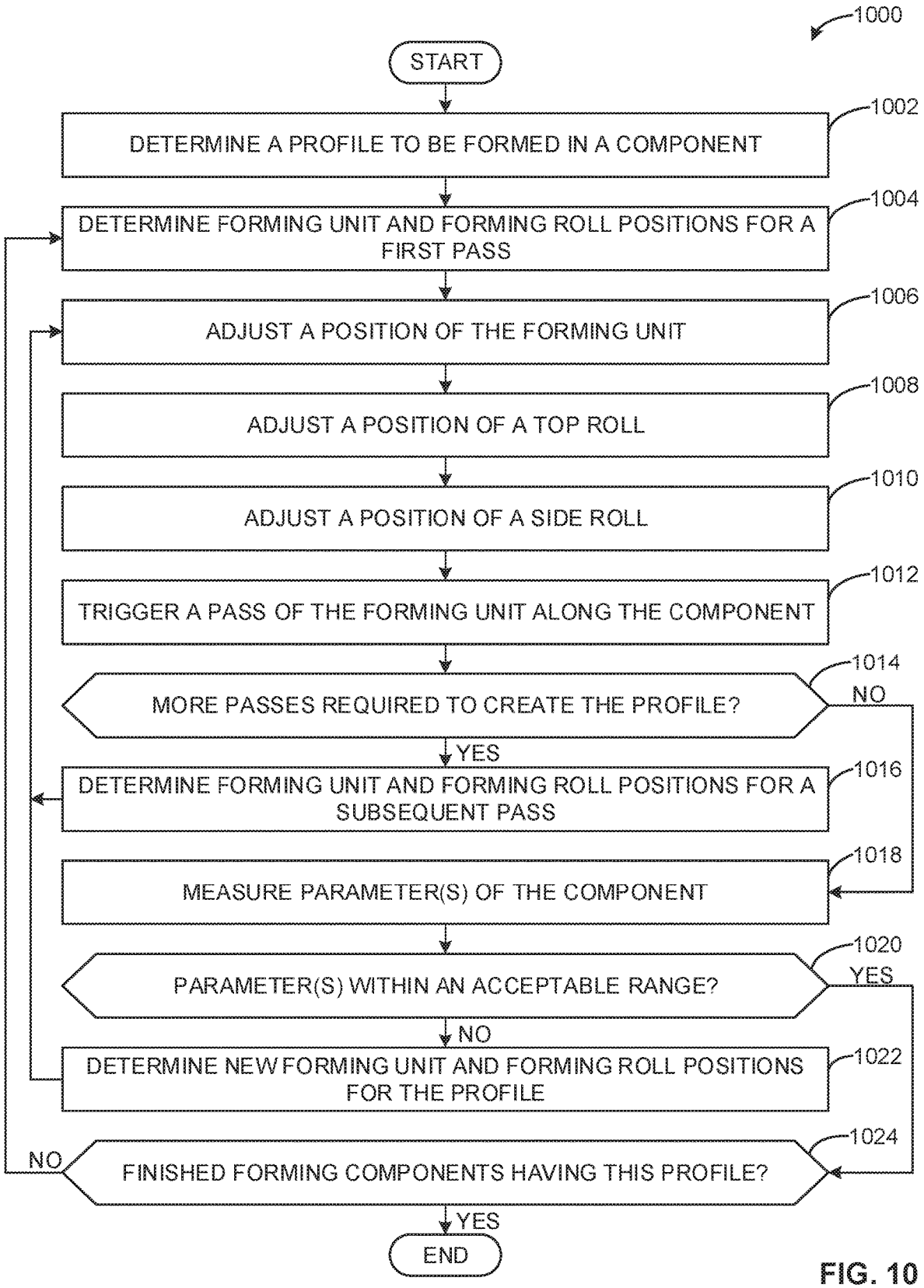
FIG. 10 is a flowchart representative of machine readable instructions that may be executed to implement the example controller of FIG. 9 to operate the example forming unit of FIG. 3.

A flowchart representative of example hardware logic, machine readable instructions, hardware implemented state machines, and/or any combination thereof for implementing the controller 208 of FIG. 9 is shown in FIG. 10. The machine readable instructions may be an executable program or portion of an executable program for execution by a computer processor such as the processor 1112 shown in the example processor platform 1100 discussed below in connection with FIG. 11. The program may be embodied in software stored on a non-transitory computer readable storage medium such as a CD-ROM, a floppy disk, a hard drive, a DVD, a Blu-ray disk, or a memory associated with the processor 1112, but the entire program and/or parts thereof could alternatively be executed by a device other than the processor 1112 and/or embodied in firmware or dedicated hardware. Further, although the example program is described with reference to the flowchart illustrated in FIG. 10, many other methods of implementing the example controller 208 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example processes of FIG. 10 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one of A and at least one of B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least A, (2) at least B, and (3) at least A and at least B. Similarly, as used herein in the context of describing the performance or execution of processes, instructions, actions, activities and/or steps, the phrase "at least one of A or B" is intended to refer to implementations including any of (1) at least A, (2) at least B, and (3) at least A and at least B.

FIG. 10 is a flowchart representative of machine readable instructions that may be executed to implement the example controller 208 of FIG. 9 to operate the example forming unit 206 of FIG. 3. The program 1000 of FIG. 10 begins at block 1002 where the controller 208 determines a profile to be formed in a component (e.g., the component 202 of FIG. 2). For example, the controller 208 receives input from an operator via the example input devices 212 of FIG. 2 to determines the desired profile for a cross-section of the component 202. In some examples, the profile information is received by the example sensor interface 902 of FIG. 9 and transmitted to the example data analyzer 904 of FIG. 9.

At block 1004, the controller 208 determines forming unit (e.g., the forming unit 206) and forming roll (e.g., the top roll 304, side roll 316, and/or bottom roll 318 of FIG. 3) positions for a first pass. For example, the data analyzer 904 determines the positions and/or angles of the forming unit 206, the top roll 304, the side roll 316, and/or the bottom roll 318 that will be implemented during the first pass of the forming unit 260 along the component 202.

The controller 208 further adjusts a position of the forming unit 206 (block 1006). For example, the forming unit controller 908 adjusts the position and/or angle of the forming unit 206 (e.g., relative to the component 202) based on the position determined by the data analyzer 904 for the first pass. In some examples, the forming unit 206 is operatively coupled to a robot arm (e.g., the robot arm 502 of FIG. 5A) that controls a position of the forming unit 206 relative to the component 202 and/or an angle of the forming unit 206 relative to the component 202.

At block 1008, the controller 208 adjusts a position of a top roll (e.g., the top roll 304 of FIG. 3). For example, the top roll controller 910 adjusts the local position and/or the local angle of the top roll 304 for the first pass based on the position information determined by the data analyzer 904. In some examples, the top roll controller 910 controls the example top roll adjustor 312 of FIG. 3 operatively coupled to the top roll 304 to adjust the local position and/or the local angle of the top roll 304.

At block 1010, the controller 208 adjusts a position of a side roll (e.g., the side roll 316 of FIG. 3). For example, the side roll controller 912 adjusts the local position and/or the local angle of the side roll 316 for the first pass based on the position information determined by the data analyzer 904. In some examples, the side roll controller 912 controls the example side roll adjustor 406 of FIG. 4C operatively coupled to the side roll 316 to adjust the local position and/or the local angle of the side roll 316. The side roll controller 912 adjusts the side roll 316 to establish a forming angle for a pass of the forming unit 206 along the component 202.

The controller 208 further triggers a pass of the forming unit 206 along the component (block 1012). For example, when the forming unit 206, the top roll 304, and the side roll 316 are positioned as determined by the data analyzer 904, the controller 208 moves the forming unit 206 along the component 202 on the example parallel track 216 of FIG. 2. Additionally or alternatively, the controller 208 can provide instructions to the robot arm 502 of FIG. 5A to move the forming unit 206 along the component 202.

At block 1014, the controller 208 determines whether more passes are required to create the profile. For example, the data analyzer 904 determines a number of passes the forming unit 206 is to make along the component 202 based on the profile and the thickness of the component 202. When the forming unit 206 completes a pass along the component 202 (e.g., at block 1012), the data analyzer 904 determines whether one or more passes remains to be completed by the forming unit 206. If the data analyzer 904 determines that additional passes are needed to complete the profile in the component 202, control proceeds to block 1016. On the other hand, when the data analyzer 904 determines that no additional passes are needed, control of program 1000 proceeds to block 1018.

The controller 208 further determines forming unit and forming roll positions for a subsequent pass (block 1016). For example, the data analyzer 904 determines the positions for the forming unit 206 and the forming rolls 304, 316, 318 during each pass of the forming unit 206 along the component 202. Once a pass is completed, the positions to be used in the subsequent pass are determined by the data analyzer 904. In some examples, the data analyzer 904 determines the positions to be used in each of the passes when the profile is determined (e.g., at block 1002). In some such examples, after each pass the position information for the subsequent pass is loaded by the forming unit controller 908, the top roll controller 910, the side roll controller 912, and/or the bottom roll controller 914. In some examples, the position of the bottom roll 318 does not change between passes, and thus the program 1000 does not further adjust the position of the bottom roll 318. When the controller 208 has determined the forming unit and forming roll positions for the subsequent pass, control returns to block 1006 where the position of the forming unit 206 is adjusted.

At block 1018, the controller 208 measures a parameter or parameters of the component 202. For example, the sensors 210 (e.g., a profilometer) can measure a parameter of the component 202, such as a length of a leg (e.g., the leg 104 of FIGS. 1A and 1B), and angle between a web (e.g., the web 102 of FIGS. 1A and 1B) and the leg 104, a length of the web 102, and/or any other measurable characteristic of the component 202. The sensor interface 902 receives information from the sensors 210 and transmits the sensor information to the example component comparator 906 of FIG. 9.

The controller 208 further determines whether the parameter or parameters are within an acceptable range such as, for example, within or meeting a desired threshold or tolerance (block 1020). For example, the component comparator 906 compares the measured parameters with acceptable values or an acceptable range of values. When the parameters are within the acceptable range, control proceeds to block 1024. When the component comparator 906 determines that the measured parameters are outside of the acceptable range such as, for example, not within or meeting a desired threshold or tolerance, control proceeds to block 1022.

At block 1022, the controller 208 determines new forming unit and forming roll positions for the profile. For example, when the component comparator 906 determines a measured parameter of the component 202 is outside of the acceptable range, the component comparator 906 transmits the results of the comparison to the data analyzer 904. The data analyzer 904 uses the results of the comparison to determine changes to the forming unit and forming roll positions. For example, angles that are too large (e.g., that are above the acceptable range) cause the data analyzer 904 to determine changes to the side roll position to reduce the forming angle created between the top roll 304 and the side roll 316. Additionally or alternatively, any other changes to the position of the forming unit 206, the top roll 304, the side roll 316, and/or the bottom roll 318 can be made based on the results of the comparison. When the controller 208 has determined the forming unit and forming roll positions for the subsequent pass, control returns to block 1006 where the position of the forming unit 206 is adjusted.

At block 1024, the controller 208 determines whether the forming unit 206 has finished forming components 202 having this profile (e.g., the same profile). For example, the data analyzer 904 can determine a number of components 202 that are to be formed having the same profile (e.g., the profile determined at block 1002). When the data analyzer 904 determines that not all of the components 202 that are to be formed using this profile have been formed by the forming unit 206, control returns to block 1004, where the controller 208 determines forming unit and forming roll positions for a first pass (e.g., of a new component). When the data analyzer 904 determines that all components having the same profile have been formed, the program 1000 concludes.

As discussed above in connection with FIG. 9, the measuring of parameters of the component 202 (e.g., at block 1018) and the determination of new forming unit and forming roll positions for the profile (e.g., block 1022) can be implemented throughout each pass and/or between passes relating to a single component.

Figure 11:
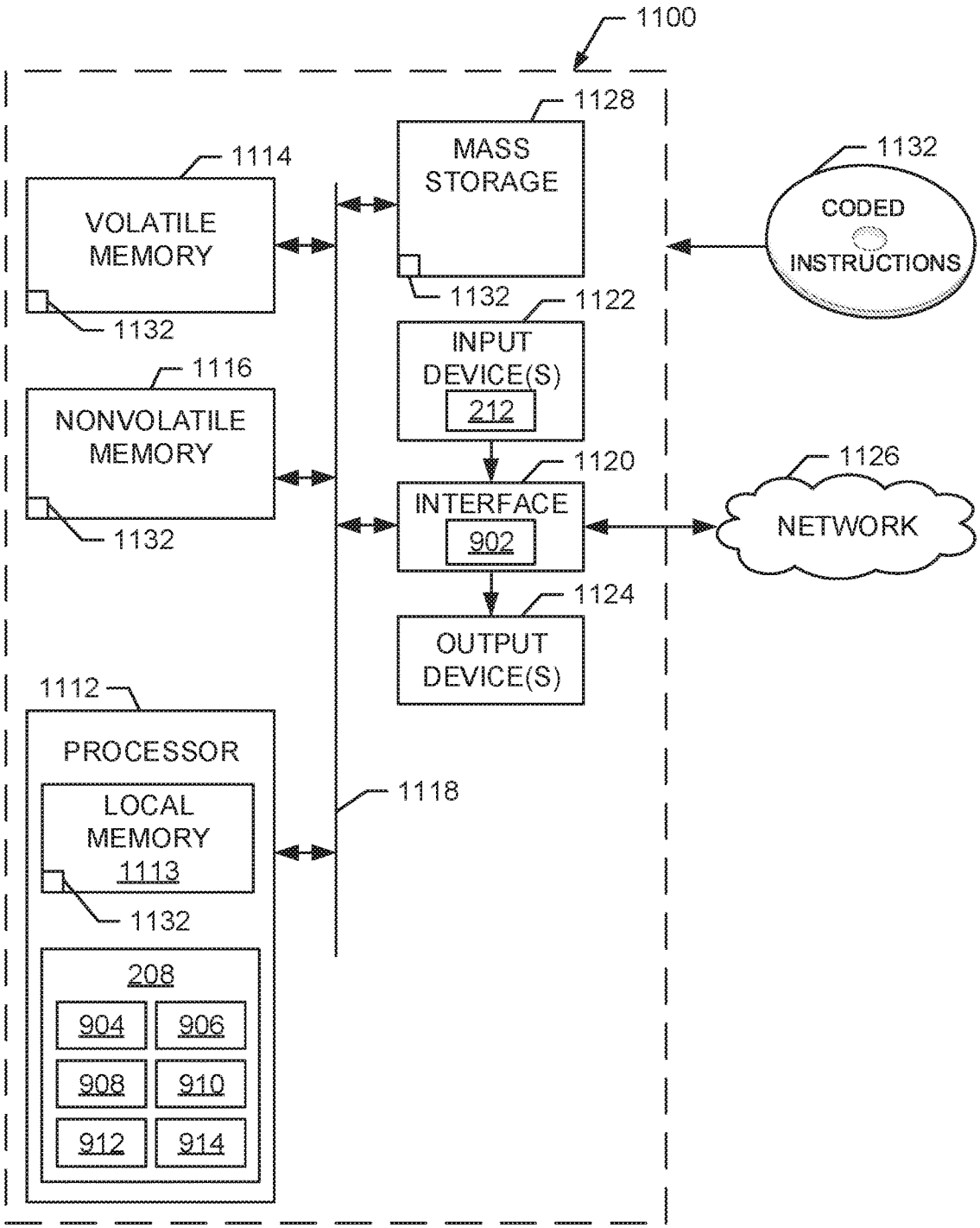
FIG. 11 is a block diagram of an example processing platform structured to execute the instructions of FIG. 10 to implement the controller of FIG. 9.

FIG. 11 is a block diagram of an example processor platform 1100 structured to execute the instructions of FIG. 10 to implement the controller 208 of FIG. 9. The processor platform 1100 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements the example data analyzer 904, the example component comparator 906, the example forming unit controller 908, the example top roll controller 910, the example side roll controller 912, and the example bottom roll controller 914.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. In this example, the interface circuit 1120 implements the sensor interface 902 of FIG. 9. The interface circuit 1120 may be implemented by any type of interface standard, such as an Ethernet interface, a universal serial bus (USB), a Bluetooth® interface, a near field communication (NFC) interface, and/or a PCI express interface.

In the illustrated example, one or more input devices 1122 are connected to the interface circuit 1120. In this example, the input devices 1122 include the input devices 212 of FIG. 2. The input device(s) 1122 permit(s) a user to enter data and/or commands into the processor 1112. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1124 are also connected to the interface circuit 1120 of the illustrated example. The output devices 1124 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 1120 of the illustrated example, thus, typically includes a graphics driver card, a graphics driver chip and/or a graphics driver processor.

The interface circuit 1120 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1126. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, redundant array of independent disks (RAID) systems, and digital versatile disk (DVD) drives.

The machine executable instructions 1132 of FIG. 9 may be stored in the mass storage device 1128, in the volatile memory 1114, in the non-volatile memory 1116, and/or on a removable non-transitory computer readable storage medium such as a CD or DVD.

From the foregoing, it will be appreciated that example methods, apparatus, systems and articles of manufacture have been disclosed that form variable component geometries in a roll-forming process. The examples disclosed herein have the capacity to form highly variable component geometries (e.g., profiles) by dynamically changing a position, orientation, and/or angle of the forming unit and/or the forming rolls operatively coupled to the forming unit. The forming unit and/or the forming rolls can change position and/or orientation throughout the entire roll-forming process. Further, in examples disclosed herein, the forming units can move along a stationary component (e.g., held stationary by magnetic forces, clamps, etc.) to form a profile in the component throughout one or more passes.

The examples disclosed herein advantageously use fewer forming units and/or forming rolls to accomplish the same scope of work as known roll-forming processes. Further, the forming unit can include both forming rolls to form the component cross-sections as well as accessories used to separate materials (e.g., laser cutters) to perform multiple tasks using the same forming unit. The ability of a forming unit to both separate and form components minimizes the space requirements (e.g., both tasks can be performed using a single machine). Further, a number of actuators and tolerance stack-up issues (e.g., multiple incorrect tolerances occurring consecutively) are both reduce by having the forming unit perform both separation and forming of the components.

The presence of defects in the component is also reduced using the examples disclosed herein. For example, in conventional roll-forming systems, the slapping effect that occurs at an entry of a component into the roll-forming system due to the component hitting forming rolls while moving forward (e.g., any impact on a front surface of the component can cause a defect) increases the amount of flare and/or buckling defects present in the component. The examples disclosed herein reduce and/or eliminate the slapping effect by having the forming unit engage the component and subsequently begin to form the component. Further, some examples disclosed herein form the component by moving the forming unit in alternating directions along the component, alternating longitudinal strain and balancing stresses in the component. The equalized stress and strain in the component further reduce the presence of defects such as bow and twist.

The examples disclosed herein advantageously provide an "infinite center distance" between passes by passing the forming unit over the component. For example, in known roll-forming methods, the distance between work rolls (e.g., stationary work rolls) creates problems and defects in some circumstances (e.g., if there was not enough distance between the work rolls). Because the work rolls of the forming unit are not a set distance apart (e.g., because the forming unit moves along the component), these problems and defects are eliminated.

To further reduce the presence of defects in the components, the methods, apparatus, systems, and articles of manufacture disclosed herein advantageously enhance and optimize a forming angle progression for a given component. In some examples disclosed herein the forming angle progression is adjusted to determine the optimized forming angle progression for a given component profile. For example, the controller adjusts parameters of the forming process (e.g., number of passes, speed of the passes, etc.) and determines whether the changes have advantageous results, such as increased production times or decreased defect occurrence. In some examples, defects such as flare and bow are more effectively neutralized by using more passes of the forming unit along the component (e.g., as opposed to retroactively correcting the defect once the component has been completed). By optimizing the progression of the forming angle, the examples used herein can reduce the number of defects present in the component upon completion and reduce the number of defects that are to be fixed retroactively.

The examples disclosed herein further enhance and optimize a forming angle progression used to form parts having different thicknesses. For example, when a thickness between different component changes (e.g., for a same component profile), the forming angle progression changes to accommodate for the difference in thickness of the component. In some examples, an increase in thickness prompts an increase in the number of passes of the forming unit, and, thus, the change in forming angle decreases between each pass. Alternatively, if the thickness of the component is decreases, fewer passes are used and the forming angle progression occurs more rapidly (e.g., there are larger changes in forming angle between each pass). In some examples, the controller associated with the forming unit determines the forming angle progression to properly form the part given a particular component thickness.

Disclosed herein is an example roll-forming apparatus that includes a forming unit to move along a stationary component to form a cross-section in the component. The example apparatus also includes a first roll operatively coupled to the forming unit to engage the component and a second roll operatively coupled to the forming unit to set a forming angle for movement along the component, the component formed between the first roll and the second roll.

In some examples, the cross-section is a variable cross-section. In some examples, the roll-forming apparatus further includes a third roll operatively coupled to the forming unit to engage the component to generate an interface between the component and the forming unit. In some examples, the component is held stationary by a clamp, a mechanical stop pin, a pneumatic suction cup, or a magnetic force. Further, in some examples, the first roll is adjusted based on a thickness of the component. In some examples, the second roll is adjusted to adjust the forming angle.

In some examples, a position of the forming unit relative to the component is adjusted for movement of the forming unit along the component. In some examples, a position of the forming unit relative to the component is adjusted during movement of the forming unit along the component. In some examples, the roll-forming apparatus further includes a robot arm operatively coupled to the forming unit to adjust a position of the forming unit relative to the component. In some such examples, the robot arm adjusts the position of the forming unit relative to the component to facilitate movement of the forming unit along the component. Alternatively, in some such examples, the robot arm adjusts an angle of the forming unit relative to the component to adjust the forming angle. In some such examples, the robot arm rotates the forming unit to invert the forming angle set by the second roll. Further, in some examples, the roll-forming apparatus further includes a sensor to determine a parameter of the component, where the first roll, second roll, or forming unit is adjusted based on the parameter of the component.

In some examples, the roll-forming apparatus further includes pins operatively coupled to the forming unit to locate the component and align the forming unit with the component prior to movement of the forming unit along the component. Further, in some examples, the roll-forming apparatus further includes a cutting tool operatively coupled to the forming unit to cut the component prior to forming the cross-section. In some examples, the forming unit is to engage the component prior to movement of the forming unit along the component. In some examples, the forming unit is to move along the component in a first pass in a first direction and in a second pass in a direction opposite the first direction.

Further, disclosed herein is an example tangible computer readable storage medium comprising instructions that, when executed, cause a machine to at least move a forming unit relative to a stationary component to form a constant or variable cross-section, position a first roll to engage the component, the first roll operatively coupled to the forming unit, and position a second roll to set a forming angle for movement along the component, the component formed between the first roll and the second roll.

In some examples, the instructions further cause the machine to position a third roll to engage the component to generate an interface between the component and the forming unit, the third roll operatively coupled to the forming unit. In some examples, the component is held stationary by a clamp, a mechanical stop pin, a pneumatic suction cup, or a magnetic force. Further, in some examples, the instructions, when executed, further cause the machine to adjust the second roll to adjust the forming angle.

In some examples, the instructions, when executed, further cause the machine to adjust a position of the forming unit relative to the component for movement of the forming unit along the component. In some examples, the instructions, when executed, further cause the machine to adjust a position of the forming unit relative to the component during movement of the forming unit along the component. In some further examples, the instructions, when executed, further cause the machine to adjust a robot arm operatively coupled to the forming unit to adjust the position of the forming unit relative to the component. In some examples, the instructions, when executed, further cause the machine to determine a parameter of the component and adjust the first roll, second roll, or forming unit based on the parameter of the component.

Disclosed herein is an example roll-forming apparatus comprising a forming unit to form a cross-section in a component during movement of the component along the forming unit, an angle of the forming unit relative to the component adjustable during movement of the component, and a first roll operatively coupled to the forming unit to engage a first surface of the component. The example roll-forming apparatus further includes a second roll operatively coupled to the forming unit to engage a second surface of the component opposite the first surface and a third roll operatively coupled to the forming unit to apply a force to the component to form the cross-section, an angle of the third roll relative to the component adjustable during movement of the component along the forming unit.

In some examples, the roll-forming apparatus further includes a transporter to move the component along the forming unit. In some such examples, the transporter includes at least one of a feed roll, a traveling gripper system, or a robot arm. In some examples, the first roll, the second roll, and the third roll are to rotate at a speed equal to a speed that the component is moving along the forming unit. Further, in some examples, the roll-forming apparatus further includes a robot arm to adjust the angle of the forming unit relative to the component. In some such examples, the robot arm is to adjust a position of the forming unit relative to the component. In some examples, the component is to move in alternating directions along the forming unit during consecutive passes, wherein a pass is defined by movement of the component through the forming unit.

Further, disclosed herein is an example roll-forming apparatus comprising a forming unit to pass along a component to form a cross-section of the component, the forming unit including a first roll to engage the component and a second roll to set a forming angle and apply a force to the component and a controller to obtain a parameter of the component and adjust a position of one or more of the forming unit, the first roll, or the second roll relative to the component based on a parameter of the component. In some examples, the parameter of the component is a dimension of a web or a leg of the component.

In some examples, when the parameter is indicative of a defect in the component, the controller is to adjust the position of the forming unit or the second roll to remove the defect. In some examples, the controller is to adjust a speed of translation of the forming unit, a speed of rotation of the first roll, and a speed of rotation of the second roll. In some such examples, the controller is to maintain the speed of rotation of the first roll and the speed of rotation of the second roll equal to the speed of translation of the forming unit. In some such examples, the controller is further is adjust the position or the speed of translation of the forming unit relative to the component, measure a parameter of the component, and determine whether the adjustment to the position or the speed of translation is to be used in a subsequent pass of the forming unit along the component.

In some examples, the controller is to adjust the position of the forming unit or the second roll during the pass of the forming unit along the component. In some such examples, the controller is to adjust an angle of the second roll relative to the component during the pass of the forming unit along the component. In some examples, the controller is to adjust the position of the forming unit or the second roll after the pass of the forming unit along the component. In some examples, the forming unit is to move in a first direction in a first pass and in a second direction opposite the first direction in a second pass. In some examples, the forming unit is to engage the component prior to passing along the component. Further, in some examples, a sensor to detect an outer edge of the component, the controller to position the forming unit during the pass based on the detection of the outer edge.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A machine to form a cross-section in a stationary component, the machine comprising:

a first roll to engage the stationary component;

a second roll to set a forming angle for movement along the stationary component, the stationary component formed between the first roll and the second roll;

a first cam follower upstream relative to the first roll and the second roll;

a second cam follower downstream relative to the first roll and the second roll, the first cam follower and the second cam follower to maintain a vertical position of a peripheral edge of the stationary component, the second cam follower including a brush to contact the stationary component, the brush to remove galvanization from the stationary component, and the first roll, the second roll, the first cam follower, and the second cam follower configured to move together along the stationary component;

an arc-shaped gear including teeth on an outer surface of the arc-shaped gear, an inner surface of the arc-shaped gear defining a cutout in the arc-shaped gear, the second roll coupled to the inner surface at the cutout; and a worm gear operatively coupled to the teeth of the arc-shaped gear, rotation of the worm gear to cause rotation of the arc-shaped gear, the second roll to rotate with the arc-shaped gear about a fixed point to adjust the forming angle.

2. The machine of claim 1, wherein the first roll, the second roll, the first cam follower, and the second cam follower form a forming unit, the machine further including a controller to move the forming unit relative to a central axis of the stationary component to form a variable cross-section in the stationary component, the controller to determine a number of passes the forming unit is to make along the stationary component.

3. The machine of claim 1, further including a third roll to engage the stationary component to generate an interface between the stationary component and the machine, the third roll adjustable independently from the first and second rolls.

4. The machine of claim 1, further including at least one of a clamp, a mechanical stop pin, a pneumatic suction cup, or a magnetic force to hold the stationary component.

5. The machine of claim 1, further including a roll adjuster to adjust the first roll based on a thickness of the stationary component.

6. The machine of claim 1, further including a roll adjuster operatively coupled to the worm gear to cause the rotation of the worm gear to adjust the forming angle.

7. The machine of claim 1, wherein the first roll, the second roll, the first cam follower, and the second cam follower form a forming unit, the machine further including a robot arm to adjust a position of the forming unit relative to the stationary component to move the forming unit along the stationary component.

8. The machine of claim 1, wherein the first roll, the second roll, the first cam follower, and the second cam follower form a forming unit, the machine further including a robot arm operatively coupled to the forming unit to adjust a position of the forming unit relative to the stationary component, the robot arm including a first joint, a second joint, and a third joint, the robot arm translatable and rotatable about each of an x-axis, a y-axis, and a z-axis.

9. The machine of claim 8, wherein the robot arm is to adjust the position of the forming unit relative to the stationary component to move the forming unit along the stationary component.

10. The machine of claim 8, wherein the robot arm is to adjust an angle of the forming unit relative to the stationary component to adjust the forming angle.

11. The machine of claim 10, wherein the robot arm is to rotate the forming unit to invert the forming angle set by the second roll.

12. The machine of claim 8, wherein the first cam follower includes pins to locate the stationary component and align the forming unit with the stationary component prior to the robot arm moving the forming unit along the stationary component.

13. The machine of claim 8, wherein the forming unit is to engage the stationary component prior to the robot arm moving the forming unit along the stationary component.

14. The machine of claim 8, wherein the robot arm is to move the forming unit along the stationary component in a first pass in a first direction and in a second pass in a direction opposite the first direction.

15. The machine of claim 1, further including:

a sensor to determine a parameter of the stationary component; and a controller to adjust both the first roll and the second roll based on the parameter of the stationary component.

16. The machine of claim 1, further including slitting rolls upstream relative to the first cam follower to cut the stationary component prior to the machine forming the cross-section.

17. The machine of claim 1, wherein the first roll includes an upper portion and a lower portion, a diameter of the first roll to decrease from an intersection between the upper and lower portions toward both a first edge of the upper portion distal to the intersection and a second edge of the lower portion distal to the intersection, the first roll to include a rounded surface at the intersection.

18. The machine of claim 17, wherein the first edge of the upper portion is closer to the intersection than the second edge of the lower portion is to the intersection.

19. A machine to form a cross-section in a component, the machine comprising:

a first roll to engage a first surface of the component;

a second roll to engage a second surface of the component opposite the first surface;

a third roll to apply a force to the component to form the cross-section, a first angle of the third roll relative to the component being adjustable during movement of the component along the third roll; and a first cam follower upstream relative to the first, second, and third rolls;

a second cam follower downstream relative to the first, second, and third rolls, the first cam follower and the second cam follower to maintain a vertical position of a peripheral edge of the component, the first, second, and third rolls and the first and second cam followers configured to move together along the component;

an arc-shaped gear including teeth on an outer surface of the arc-shaped gear, the third roll coupled to an inner surface of the arc-shaped gear; and a worm gear operatively coupled to the teeth of the arc-shaped gear, rotation of the worm gear to cause rotation of the arc-shaped gear, the third roll to rotate with the arc-shaped gear about a fixed point to adjust the first angle.

20. The machine of claim 19, wherein the first, second, and third rolls and the first and second cam followers form a forming unit, the first roll, the second roll, and the third roll to rotate at a speed equal to a speed that the component is moving along the forming unit.

21. The machine of claim 19, wherein the first, second, and third rolls and the first and second cam followers form a forming unit, further including a robot arm to adjust a second angle of the forming unit relative to the component.

22. The machine of claim 21, wherein the robot arm is to adjust a position of the forming unit relative to the component.

23. A machine to form a cross-section in a component, the machine comprising:

a first roll to engage the component;

a second roll to set a forming angle for the component during movement of the component relative to the first and second rolls, the component formed between the first roll and the second roll;

a first cam follower upstream relative to the first roll and the second roll;

a second cam follower downstream relative to the first roll and the second roll, the first cam follower and the second cam follower to maintain a vertical position of a peripheral edge of the component, the second cam follower including a brush to contact the component, the brush to remove galvanization from the component;

an arc-shaped gear having a convex first surface and a concave second surface, the second roll coupled to the concave second surface of the arc-shaped gear;

a plurality of teeth coupled to the convex first surface of the arc-shaped gear; and a worm gear operatively coupled to the teeth of the arc-shaped gear, rotation of the worm gear to cause rotation of the arc-shaped gear, the second roll to rotate with the arc-shaped gear about a fixed point to adjust the forming angle.

* * * * *